US006491382B2

(12) United States Patent
Taneya et al.

(10) Patent No.: US 6,491,382 B2
(45) Date of Patent: Dec. 10, 2002

(54) LIQUID DISCHARGE HEAD AND APPARATUS HAVING RESTRICTED MOVEMENT OF A MOVABLE MEMBER

(75) Inventors: Yoichi Taneya, Kanagawa; Hiroyuki Ishinaga; Yoshinori Misumi, both of Tokyo; Hiroyuki Sugiyama, Kanagawa, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/915,423

(22) Filed: Jul. 27, 2001

(65) Prior Publication Data

US 2002/0044177 A1 Apr. 18, 2002

(30) Foreign Application Priority Data

Jul. 31, 2000 (JP) ..... 2000-232410

(51) Int. Cl.[7] ..... B41J 2/05; B41J 2/17
(52) U.S. Cl. ..... 347/65; 347/94
(58) Field of Search ..... 347/56, 63, 54, 347/65, 67, 94, 20, 44

(56) References Cited

U.S. PATENT DOCUMENTS

| | | | |
|---|---|---|---|
| 4,723,129 A | 2/1988 | Endo et al. | 347/56 |
| 5,278,585 A | 1/1994 | Karz et al. | 347/65 |
| 6,168,264 B1 | 1/2001 | Yoshihira et al. | 347/65 |

FOREIGN PATENT DOCUMENTS

| | | | |
|---|---|---|---|
| EP | 0 721 841 A2 | 7/1996 | B41J/2/05 |
| EP | 0 976 562 | 2/2000 | B41J/2/14 |
| EP | 1 005 991 | 6/2000 | B41J/2/14 |
| JP | 4-250051 * | 9/1992 | B41J/2/05 |
| JP | 5-104719 * | 4/1993 | B41J/2/05 |
| JP | 6-31918 | 2/1994 | B41J/2/05 |
| JP | 9-48127 | 2/1997 | B41J/2/05 |
| JP | 9-323420 | 12/1997 | B41J/2/05 |
| JP | 0 819 528 A2 | 1/1998 | B41J/2/05 |
| JP | 10-24588 | 1/1998 | B41J/2/05 |

* cited by examiner

*Primary Examiner*—Raquel Yvette Gordon
*Assistant Examiner*—Juanita Stephens
(74) *Attorney, Agent, or Firm*—Fitzpatrick, Cella, Harper & Scinto

(57) ABSTRACT

Disclosed is a liquid discharge head that comprises: a heat generator that generates a thermal energy for generating a bubble in a liquid; a discharge part as a portion to discharge the liquid; a flow path communicating with the discharge part and having a bubble generation region in which the bubble is generated; a movable member having a free end and is displaced with the growth of the bubble; and a restricting portion to define a displacement amount of the movable member, in which the flow path is formed by joining a substantially flat substrate provided with the heat generator the movable member and a top plate opposing to the substrate and including the restricting portion, and the liquid is discharged from the discharge part by an energy during generation of the bubble, in which the clearance between at least one sidewall of the flow path and the side edge portion of the restricting portion is larger than the clearance between the sidewall and the side edge portion of the movable member.

22 Claims, 15 Drawing Sheets

LIQUID DISCHARGE HEAD AND APPARATUS HAVING RESTRICTED MOVEMENT OF A MOVABLE MEMBER

BACKGROUND OF THE INVENTION

1. Field of the Invention

The present invention relates to a liquid discharge head and a liquid discharge apparatus that discharge a desired liquid by generation of a bubble due to thermal energy or the like, and more particularly, to a liquid discharge head and a liquid discharge apparatus having a movable member which is displaced by the use of generation of the bubble.

The term "recording" in the present invention means to attach not only an image such as a character and a figure having a meaning but also an image such as a pattern to a recording medium.

2. Description of the Related Art

Conventionally, in a recording apparatus such as a printer, an ink-jet recording method, a so-called bubble-jet recording method, has been known, in which energy such as heat is given to a liquid ink in a flow path to generate a bubble, ink is discharged from discharge part by an effort based on a steep volume change with the generation of the bubble, and the ink is adhered to the recording medium to form an image. In the recording apparatus using the bubble-jet recording method, a discharge part for discharging ink, a flow path communicating with the discharge part, and an electro-thermal converter as energy generation means for discharging ink provided in the flow path are generally provided, as disclosed in the U.S. Pat. No. 4,723,129.

According to such a recording method, a high-resolution image can be recorded in a high-speed and with a low noise, and the discharge part for discharging ink can be arranged in a high density in a head performing the recording method. Therefore, the recording method has many superior aspects that a recorded image or a color image of a high-resolution can be easily obtained by a small apparatus. Thus, the bubble-jet recording method has been used in various office appliances such as a printer, a copier and a facsimile, and furthermore, it has also been used in an industrial system such as a textile printing apparatus.

As bubble-jet technology has been used in products of various directions, the followings have been requested in recent years.

To obtain a high image quality, drive conditions are suggested by which a liquid discharge method and the like having a high discharge speed of ink and capable of performing good ink discharge based on stable bubble generation has been provided. In addition, from the viewpoint of high-speed recording, a recording method has been suggested in which the shape of the flow path is improved to obtain a liquid discharge head having a high filling (refilling) speed of a discharged liquid into the liquid flow path.

Other than the head described above, an invention having a construction to prevent a back wave being loss energy during discharge is disclosed in Japanese Patent Application Laid-Open No 6-31918, which pays attention to the back wave (a pressure directed to a direction opposite to the direction toward the discharge part) generated with generation of the bubble. The invention described in the gazette is one that a triangular portion of a triangular plate member is arranged opposing to a heater that generates the bubble. In the invention, the back wave is temporarily controlled by a little amount by the plate member. However, since the invention does not mention a relative relation between the growth of the bubble and the triangular portion nor has such conception, the invention has the following problem.

Specifically, in the invention described in the gazette, an ink droplet shape cannot be stable because the heater is positioned at the bottom of a concave portion and cannot have a communication state in-line with the discharge part. Moreover, since the growth of the bubble is permitted from the periphery of the apex portion of a triangle, the bubble grows from one side of the triangular plate member entirely to the opposite side. Accordingly, normal growth of the bubble in the liquid completes as if the plate member does not exist. Therefore, existence of the plate member is not effective to the bubble that has grown. On the contrary, refill to the heater being positioned at the concave portion causes a turbulent flow in a contraction step of the bubble because the entire plate member is surrounded by the bubble, which causes micro bubbles to accumulate in the concave portion and breaks the principle where discharge is performed based on a growing bubble.

Moreover, the European Patent Publication No. 436047A1 suggests an invention that alternately opens/closes a first valve and a second valve, the first valve blocking the vicinity of the discharge part and a bubble generation section between them and the second valve completely blocking the bubble generation section and an ink supply section between them (refer to FIG. 4 to FIG. 9 of the gazette). However, in the invention, the three chambers are severally divided in two divisions, ink following the liquid droplet tails long during discharge, and thus considerably more satellite dots are produced compared to a normal discharge method where bubble growth, contraction, and bubble disappearance are performed (thus, it is presumed that effect of meniscus withdrawal due to the bubble disappearance cannot be used). Further, although the liquid is supplied to the bubble generation section with the bubble disappearance during refilling, the liquid cannot be supplied to the vicinity of the discharge part until the next bubble growth begins. Accordingly, not only dispersion of the discharged liquid droplets is large, but also discharge response frequency is extremely small, which are not in practical levels.

On the other hand, a number of inventions using a movable member (a plate member or the like having a free end closer to the discharge part side from a fulcrum) that effectively contributes to liquid droplet discharge are suggested by the inventors, which are totally different from the prior art. Among others, Japanese Patent Application Laid-Open 9-48127 discloses an invention that defines an upper limit of a displacement of the movable member in order to prevent the action of the foregoing movable member from being troubled. In addition, Japanese Patent Laid-Open No. 9-323420 discloses an invention in which the position of a common liquid chamber in an upstream to the above-described movable member is shifted closer to the free end side of the movable member, that is, to a downstream side utilizing the advantage of the movable member. As a presumption for creating the inventions, the inventors adopted a mode that the growth of the bubble is suddenly released to the discharge part side from a state of temporarily wrapping the bubble by the movable member. Accordingly, no attention is paid to individual element of the whole bubble regarding the formation of the liquid droplet and the relative relation thereof.

As the next step, the inventors disclose an invention in Japanese Patent Application Laid-Open 10-24588 that a portion of a bubble generation region is released from the above-described movable member, which is an invention (an acoustic wave) where its attention is paid to the bubble growth by pressure wave propagation as an element regarding the liquid discharge. However, since the invention also pays attention only to the growth of the bubble during the liquid discharge, no attention is paid to individual element of the whole bubble regarding the formation of the liquid droplet and the relative relation thereof.

Despite that the front portion (an edge shooter type) of a bubble by a film boiling, which has been conventionally known, greatly influences the discharge, no invention has paid attention to this conventionally for contributing to the formation of the discharged liquid droplet more effectively. The inventors have researched this with much effort for technical resolution.

Furthermore, the inventors have obtained the following effective finding when they paid attention to the displacement of the movable member and the generated bubble.

The finding is that the displacement of the free end of the movable member to the growth of the bubble is defined (restricted) by a restricting portion (a stopper). By restricting the displacement of the movable member by the restricting portion, the growth of the bubble in the upstream of the flow path is defined, and thus energy propagates for effectively discharging the liquid toward the downstream side where the discharge part is formed.

In the liquid discharge head having the foregoing constitution, there has been a case where dissolved gas in the liquid becomes a remained bubble due to change by passage of time, temperature increase by continuous bubble growth, and the like. Specifically, the bubble generated in the flow path due to change by passage of time, temperature increase by continuous bubble growth, and the like tends to be left in the front and rear of the restricting portion. Particularly, there is a portion where the liquid is hard to flow and stagnate in the vicinity of the restricting portion, and there has been a case when the bubble is left fixedly in the portion. In the following description, such a bubble is referred to as the remained bubble, which is distinguished from the bubble for liquid discharge that is grown by heat and disappeared. If the remained bubble is left fixedly in the front and rear of the restricting portion, deterioration of printing may have been caused because a bubble foaming power was absorbed by the remained bubble to reduce a discharge amount and a discharge speed or a discharge direction became unstable.

Specifically, as shown in FIG. 17A, if a remained bubble 450 exists in the vicinity of a restricting portion 412, the liquid discharge operation shown in FIG. 17B and FIG. 17C, and then the remained bubble 450 does not move and becomes residual even if the refill (refilling of the liquid) is performed as shown in FIG. 17D. This is because the flow of the liquid progresses so as to avoid the vicinity of the restricting portion 412, little flow of the liquid is made in the vicinity of the restricting portion 412, and the remained bubble 450 is also left in the portion without being washed down. As described, when the remained bubble 450 is left in the position, a bubble foaming pressure during bubble generation by heating of a heat generator 410 as shown in FIG. 17E to FIG. 17G is absorbed by the remained bubble residual in the portion, which leads to insufficient liquid discharge.

SUMMARY OF THE INVENTION

The object of the present invention is to prevent the remained bubble from being left in the vicinity of the restricting portion and also to prevent reduction of the liquid discharge performance due to a residual remained bubble.

The present invention is a liquid discharge head that comprises: a heat generator that generates a thermal energy for generating a bubble in a liquid; an discharge part as portions to discharge the liquid; a flow path communicating with the discharge part and having a bubble generation region in which the bubble is generated; a movable member having a free end and is displaced with the growth of the bubble; and a restricting portion to define (restrict) a displacement amount of the movable member, in which the flow path is formed by joining a substantially flat substrate provided with the heat generator and the movable member and a top plate opposing to the substrate and including the restricting portion, and the liquid is discharged from the discharge part by an energy during generation of the bubble, characterized in that the clearance between at least one sidewall of the flow path and the side edge portion of the restricting portion is larger than the clearance between the sidewall and the side edge portion of the movable member.

According to the above constitution, since the liquid can flow through the clearance between the sidewall and the side edge portion of the restricting portion, the foregoing flow of the liquid generated during refilling of the liquid and the like washes down the remained bubble and discharges it from the discharge part even if the remained bubble exists in the vicinity of the restricting portion.

It is preferable that the clearance between the movable member and the restricting portion along the height direction of the flow path, in a non-displacement state of the movable member, is larger than the clearance between the sidewall of the flow path and the side edge portion of the movable member and is smaller than the clearance between the sidewall and the side edge portion of the restricting portion.

Moreover, it is preferable that the sum of the clearance between the movable member and the restricting portion along the height direction of the flow path and the clearance between the movable member and the bottom surface of the flow path, in the non-displacement state of the movable member, is smaller than the clearance between the sidewall and the side edge portion of the restricting portion.

It is also preferable that the distance between the restricting portion and the bottom surface of the flow path in the height direction of the flow path is 15 $\mu$m or more, the clearance between the sidewall and the side edge portion of the restricitng portion is 4 $\mu$m or more, and the width of the restricting portion is 90% or less of the width of the flow path.

Further, it is preferable that both side edge portions of the restricting portion is convex toward the sidewall and have a shape in which the width continuously becomes narrower from the maximum width portion to the upstream direction and the downstream direction. In this case, the remained bubble moves smoothly along the side edge portion of the restricting portion.

The present invention is also characterized in that the restricting portion is severally formed on the both sidewalls of the flow path, which has a convex shape toward the inside of the flow path, and the clearance between the both restricting portions is larger than the clearance between the sidewall and the side edge portion of the movable member. In such a case, it is preferable that the sidewall has a shape in which the width continuously becomes narrower from the maximum width portion to the upstream direction and the downstream direction.

The liquid discharge apparatus of the present invention includes the liquid discharge head of any one of the foregoing constitutions, and discharges the remained bubble of the dissolved gas in the liquid, which is left in the flow path due to bubble foaming and change by passage of time, during discharge or refilling of the liquid from the discharge part together with the liquid through the clearance between the side edge portion of the restricting portion and the inner wall of the flow path or the clearance between the two restricting portions.

Moreover, the liquid discharge apparatus includes recovery means for recovering the state of the liquid discharge head, and the remained bubble is discharged by the recovery means.

It is to be noted that the terms "upstream" and "downstream" used in the description of the present invention are expressed as an expression regarding the flow direction of the liquid that directs from a supply source of the liquid toward the discharge part via the bubble generation region (or the movable member), or regarding a constitutional direction.

In addition, the "downstream side" regarding the bubble itself means the bubble generated in the downstream side relative to the center of the bubble regarding the direction of the flow or the constitutional direction, or the bubble generated in a region downstream side of the area center of the heat generator. In the same manner, the "upstream side" regarding the bubble itself means the bubble generated in the upstream side relative to the center of the bubble regarding the direction of the flow or the constitutional direction, or the bubble generated in a region upstream side of the area center of the heat generator.

DESCRIPTION OF THE PREFERRED EMBODIMENTS

Embodiments of the present invention will be described with reference to accompanying drawings as follows.

First Embodiment

Figure 1:
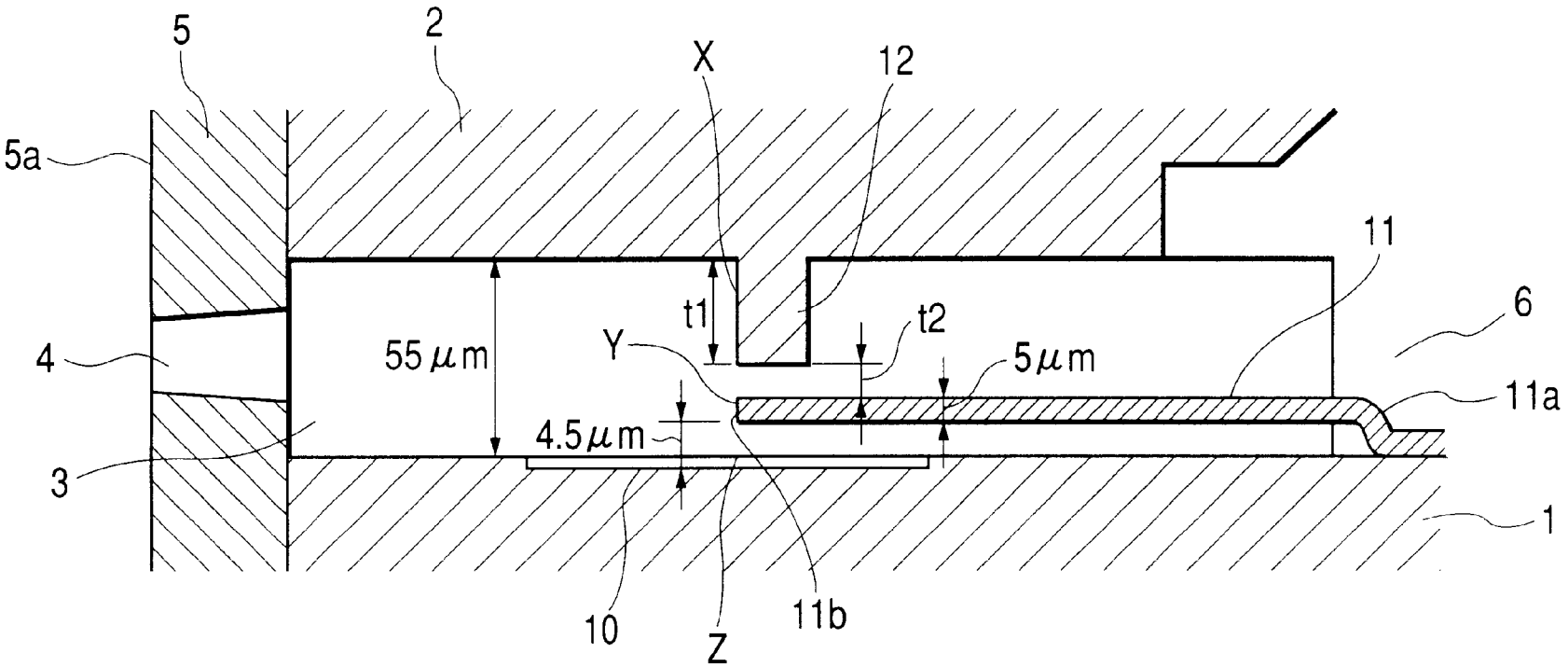
FIG. 1 is a typical side sectional view of a liquid discharge head of a first embodiment of the present invention.

FIG. 1 is a typical side sectional view of a liquid discharge head of this embodiment. And, FIGS. 2A to 2E are views explaining discharge process of the liquid from the liquid discharge head shown in FIG. 1.

The constitution of the liquid discharge head will be described by using FIG. 1.

The liquid discharge head comprises: an element substrate having a heat generator 10 as bubble generation means and a movable member 11; a top plate 2 where a stopper (a restricting portion) 12 is formed; and an orifice plate 5 where discharge part 4 is formed.

A flow path 3 where the liquid flows is formed by making the element substrate 1 and the top plate 2 fixed with each other in a laminated state. The flow path 3 is formed parallelly in the liquid discharge head in plural numbers to be communicated with the discharge part 4 discharging the liquid, which is formed in the downstream side (the left side in FIG. 1). A bubble generation region exists in a region close to a plane that contacts the heat generator 10 and the liquid. Moreover, a common liquid chamber 6 having a large volume is provided so as to communicate simultaneously with the upstream side (the right side of FIG. 1) of each flow path 3. Specifically, each flow path 3 has a shape diverged from the single common liquid chamber 6. The liquid chamber height of the common liquid chamber 6 is formed higher than that of the liquid path 3.

The movable member 11 is a cantilever state with one end being supported, fixed to the element substrate in the upstream of an ink flow, and the downstream portion from a fulcrum 11*a* is movable in a vertical direction to the element substrate 1. In an initial state, the movable member 11 is positioned approximately parallel to the element substrate 1 while keeping a gap between the element substrate 1.

The movable member 11 disposed on the element substrate 1 is disposed such that a free end 11*b* is positioned in a substantially central region of the heat generator 10. The stopper 12 provided on the top plate 2 defines the displacement amount of the free end 11*b* in an upward direction by allowing the free end 11*b* of the movable member 11 to contact the stopper 12. During a displacement amount restricting time (a movable member contacting time) of the movable member 11, the upstream side from the movable member 11 and the stopper 12 and the downstream side from the movable member 11 and the stopper 12 are substantially blocked in the flow path 3.

It is preferable that a position Y of the free end 11*b* and an end X of the stopper 12 are positioned perpendicular to the element substrate 1. More preferably, the X and Y, together with a Z being the center of the heat generator 10, are positioned on a plane perpendicular to the substrate.

Further, the height of the flow path 3 in the downstream side from the stopper 12 is suddenly increased. With this constitution, a bubble 40 in the downstream side of the bubble generation region has a sufficient flow height even when the movable member 11 is defined by the stopper 12. Accordingly, the growth of the bubble 40 is not blocked, and the liquid can be directed smoothly to the discharge part 4. Moreover, uneven pressure balance in a height direction from the bottom end to the top end of the discharge part 4 is reduced. Thus, good liquid discharge can be performed.

The ceiling shape in the common liquid chamber 6 side (upstream side) from the stopper 12 is designed to be steeply risen. In the case where the movable member 11 did not exist in this constitution, the pressure has not been easily directed to the discharge part 4 because the fluid resistance in the downstream side of the bubble generation region was larger than that in the upstream side. However, in this embodiment, the movement of the bubble 40 to the upstream side of the bubble generation region is substantially blocked during bubble formation due to the movable member 11. Accordingly, the pressure used for discharge is positively directed to the discharge part 4, and ink is quickly supplied to the bubble generation region because the fluid resistance in the upstream side of the bubble generation region is small during ink supply.

According to the foregoing constitution, the growth component to the downstream side and the upstream side of the bubble 40 are not equal, but the growth component to the upstream side is reduced to suppress the movement of the liquid to the upstream side. Since the liquid flow to the upstream side is suppressed, the withdrawal amount of the meniscus after discharge is reduced, and the amount of the meniscus protruded from an orifice plane 5*a* during refilling is also reduced accordingly. Therefore, a meniscus vibration is suppressed, and stable discharge is performed in all drive frequencies from a low frequency to a high frequency.

It is to be noted that, in this embodiment, the space between the downstream portion of the bubble 40 and the discharge part 4 is in an "in-line communication state" in which a flow path structure is in-line with the liquid flow. More preferably, it is desirable that an ideal state is formed where an discharge state of an discharged droplet 66 (described later) such as the discharge direction and the discharge speed is stabilized in a high-level by making the propagation direction of the pressure wave occurred during the generation of the bubble 40 and the flow direction and the discharge direction of the liquid with the pressure wave aligned. In this embodiment, as a definition to achieve or approach the ideal state, the discharge part 4 and the heat generator 10, particularly, a portion of the heat generator 10 closer to the discharge part 4 (downstream side), which influences a portion of the bubble 40 closer to the discharge part 4, may be directly connected in-line. This is the state where the downstream side of the heat generator 10 can be observed when viewed from outside of the discharge part 4 in the state where the liquid is not filled in the flow path 3.

Next, description will be made regarding the dimensions of each constituent element.

In the present invention, diversion of the bubble 40 to the upper surface of the movable member 11 (diversion of the bubble 40 to the upstream side of the bubble generation region) has been examined. And the inventors have found out that the diversion of the bubble 40 to the upper surface of the movable member 11 is eliminated by the relation between the moving speed of the movable member 11 and a bubble growing speed (in other words, the moving speed of the liquid), and thus a good discharge characteristic can be obtained.

Specifically, the present invention eliminates the diversion of the bubble 40 to the upper surface of the movable member 11 to obtain the good. discharge characteristic by restricting the displacement of the movable member 11 with the restricting portion 12 at the time when both the volume changing rate of the bubble 40 and the displacement volume changing rate of the movable member 11 are in an increasing tendency.

This will be described in detail by using FIG. 3 as follows.

Figure 3A:
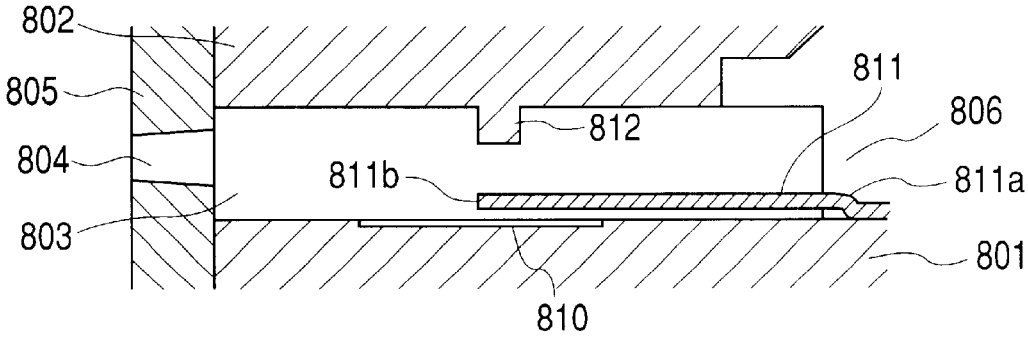
FIGS. 3A, 3B and 3C are views explaining a state where liquid flows between a movable member and a restricting portion.
Figure 3B:
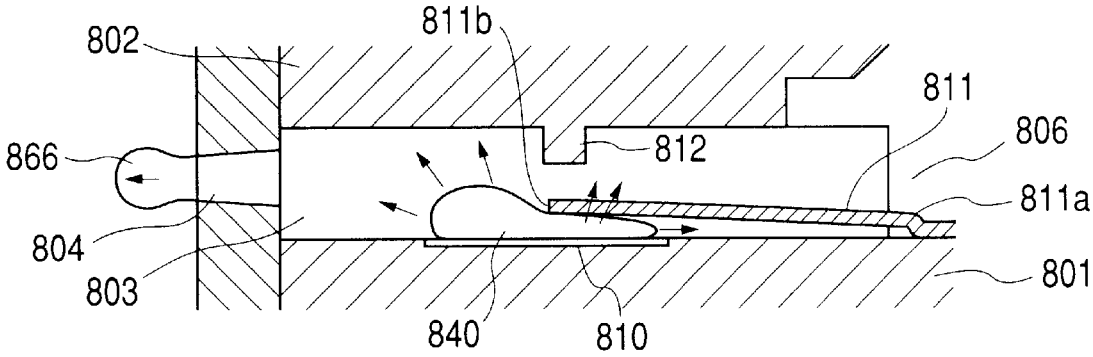
Figure 3C:
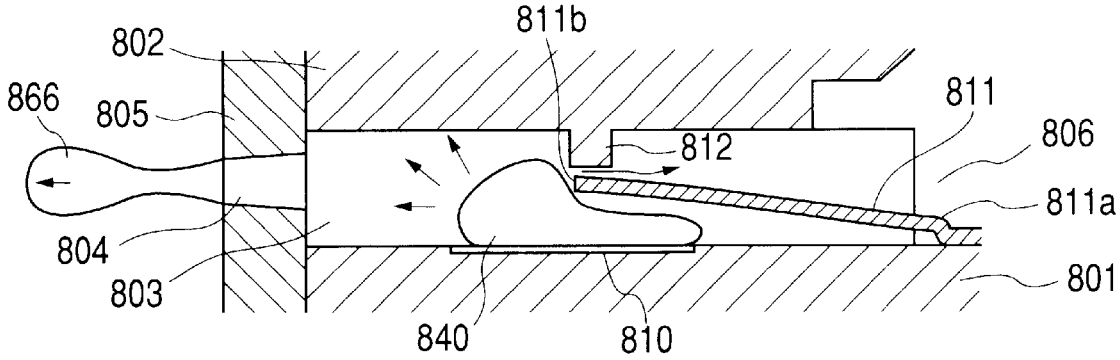

Firstly, in the state of FIG. 3A, the pressure wave is generated instantaneously when a bubble 840 is generated on a heat generator 810, and the pressure wave moves the liquid around the heat generator 810 to grow the bubble 840. Then, a movable member 811 is initially displaced upward so as to follow the movement of the liquid (FIG. 3B). When time passes, the displacement speed of the movable member 811 is suddenly reduced because the inertial force of the liquid becomes small and due to the elasticity of the movable member 811. At this point, since the moving speed of the liquid is not reduced so much, the difference between the moving speed of the liquid and that of the movable member 811 becomes larger. Then, in the case where the gap between the movable member 811 (a free end 811*b*) and a stopper 812 is still wide as shown in FIG. 3C, the liquid flows into the upstream side (an arrow direction) of the bubble generation region through the gap, which makes the state where the movable member 811 is hard to contact the stopper 812 and a part of discharge force is lost. Therefore, in such a case, a restricting (blocking) effect of the movable member 811 by the restricting portion (the stopper 812) cannot be exerted.

On the other hand, in the present invention, restricting of the movable member 11 by the restricting portion 12 is performed at the stage where the displacement of the movable member 11 substantially follows the movement of the liquid. Herein, in the present invention, the displacement speed of the movable member 11 and the growing speed (the moving speed of the liquid) are respectively expressed as a "changing rate of the displacement volume of the movable member" and a "changing rate of the bubble volume" for convenience. It is to be noted that the "changing rate of the displacement volume of the movable member" and "changing rate of the bubble volume" are ones that the displacement volume of the movable member and the bubble volume are differentiated.

With such a constitution, the liquid flow causing the diversion of the bubble 40 to the upper surface of the movable member 11 is substantially eliminated and a closed state of the bubble generation region can be more ensured. Thus, the good discharge characteristic can be obtained.

Furthermore, according to this constitution, the bubble 40 keeps on growing even after the movable member 11 is defined by the stopper. At this point, it is desirable that the flow path height of the flow path 3 in the downstream portion from the stopper 12 is sufficiently provided so as to promote free growth of the downstream side component of the bubble 40.

In the present invention, restricting the displacement of the movable member by the restricting portion refers to the state where the changing rate of the displacement volume of the movable member is 0 or negative.

Figure 4:
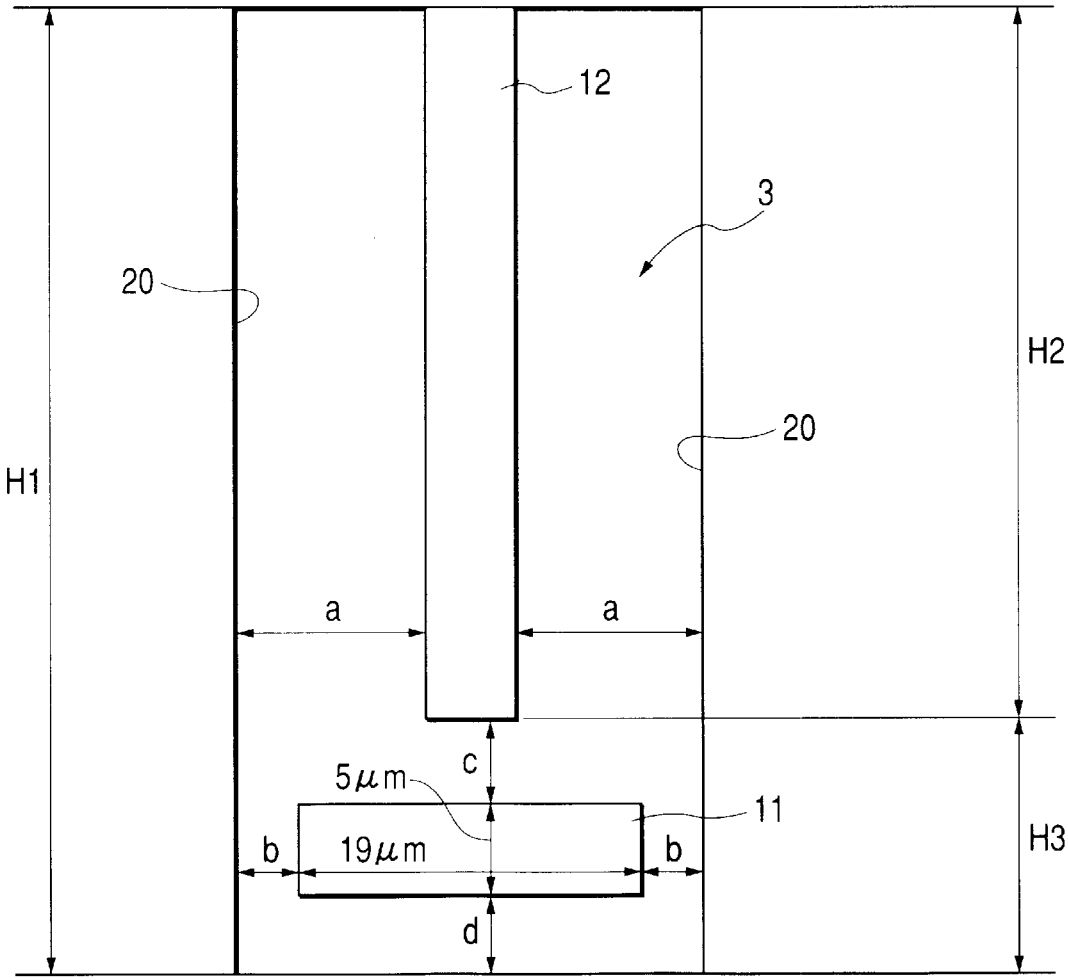
FIG. 4 is an enlarged sectional view of a principal portion of the liquid discharge head shown in FIG. 1 in a direction perpendicular to a flow path.

As shown in FIG. 4, The clearance "a" between a sidewall 20 and the side edge portion of the stopper 12 is larger than the clearance "b" between the sidewall 20 of the flow path 3 and the side edge portion of the movable portion 11. Specifically, the clearance "a" is 10 $\mu$m and the clearance "b" is 3 $\mu$m in this embodiment. Moreover, the clearance "c" between the movable member 11 and the stopper along the height direction of the flow path 3 in the non-displacement state of the movable member 11 (the state where the bubble 40 is not generated) is 5 $\mu$m. The relation of a>c>b is established. In addition, the clearance "d" between the movable member 11 and the bottom surface of the flow path 3 (the upper surface of the element substrate) along the height direction of the flow path 3 in the non-displacement state of the movable member 11 is 4.5 $\mu$m, and the sum (c+d) of the clearance "d" and the foregoing clearance "c" is 9.5 $\mu$m which is smaller than the foregoing clearance "a". In the drawing, reference symbol $H_1$ denotes a flow path height; $H_2$, a protrusion height of the stopper; and $H_3$, a stopper height.

It is to be noted that, in this embodiment, the height and the width of the flow path 3 are 55 $\mu$m and 25 $\mu$m respectively, the thickness and the width of the movable member 11 is 5 $\mu$m and 19 $\mu$m respectively, and the protrusion height (the height from the flow path ceiling plane of the top plate 2 to the tip portion of the stopper 12) and the width of the stopper 12 are 30.5 $\mu$m and 5 $\mu$m respectively. When the height of the stopper is $t_1$ and the gap between the upper surface of the movable member 11 and the stopper 12 in a height direction is $t_2$ (=c), stable discharge characteristic of the liquid could be exerted by setting $t_2$ to 15 $\mu$m or less when $t_2$ is 30 $\mu$m or more. This embodiment sufficiently satisfies the condition because $t_2$=30.5 $\mu$m and $t_2$=c=5 $\mu$m. It is to be noted that, in each drawing other than FIG. 4, each dimension does not include an error for easy reading and is not shown accurately.

Next, the discharge operation of the liquid discharge head of this embodiment will be described in detail by using FIG. 2A to FIG. 2E and FIG. 5 showing the displacement speed and the temporal change of the volume of the bubble and the displacement speed and the displacement volume of the movable member.

Figure 5:
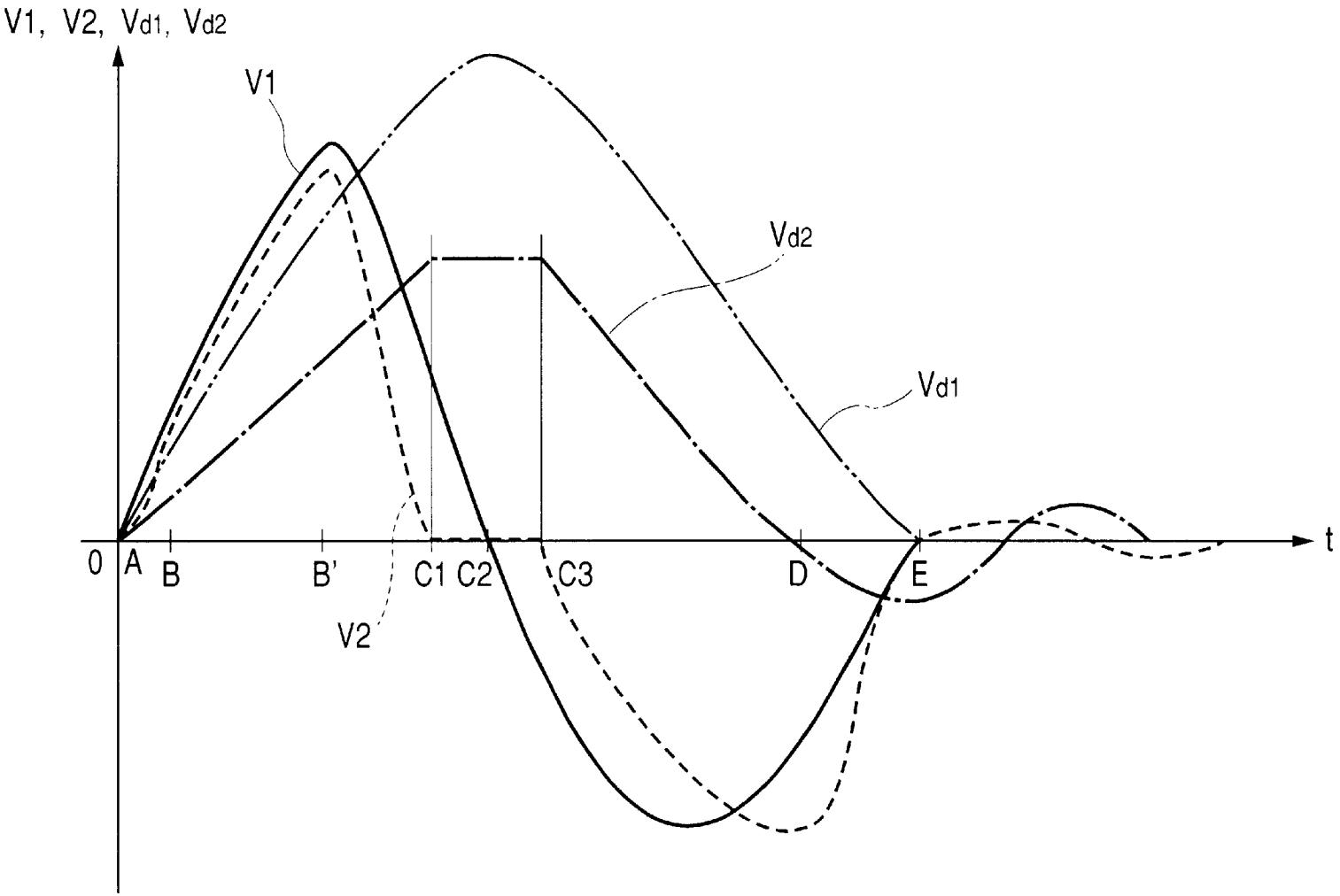
FIG. 5 is a graph showing a temporal change of a displacement speed and a volume of a bubble and a displacement speed and a displacement volume of the movable member.

In FIG. 5, the changing rate of the bubble volume $v_1$, the bubble volume $V_{d1}$, the changing rate of the displacement volume of the movable member $v_2$ and the displacement volume of the movable member $V_{d2}$ are respectively shown in a solid line, a two-dot chain line, a broken line and a one-dot chain line. In addition, the changing rate of the bubble volume $v_1$, the bubble volume $V_{d1}$, the changing rate of the displacement volume of the movable member $v_2$ and the displacement volume of the movable member $V_{d2}$ show the rise of the bubble volume $V_{d1}$, the volume, the displacement volume of the movable member $V_{d2}$ and the volume respectively as a positive. Since the displacement volume of the movable member $V_{d2}$ shows the rise of the volume when the movable member 11 is displaced from the initial state of FIG. 2A to the top plate 2 as the positive, the displacement volume of the movable member $V_{d2}$ shows a negative value when the movable member 11 is displaced from the initial state to the element substrate 1 side.

Figure 2A:
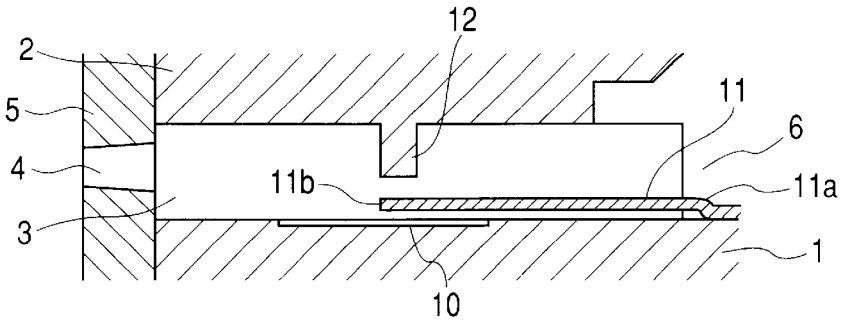
FIGS. 2A, 2B, 2C, 2D and 2E are views explaining discharge process of the liquid from the liquid discharge head shown in FIG. 1.

FIG. 2A is a state before the energy such as an electric energy is applied to the heat generator 10, which shows a state before the heat generator 10 generates heat. The movable member 11, as described later, is positioned relative to the bubble generated by the heat from the heat generator in a region opposing to a half portion of the bubble 40 of the upstream side.

This state is equivalent to an A point of time=0 in FIG. 5.

Figure 2B:
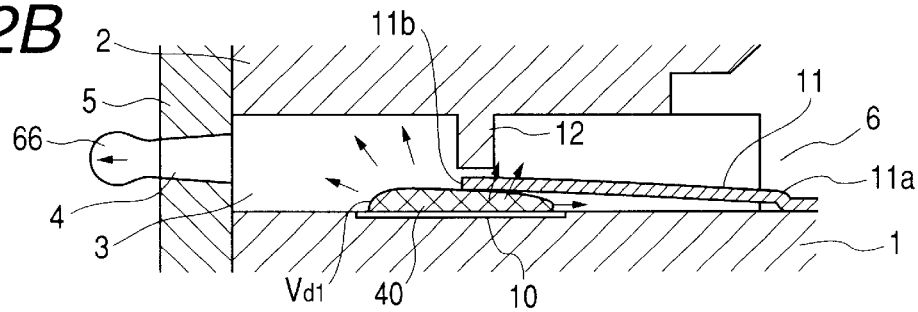

FIG. 2B shows the state where a part of the liquid that fills the bubble generation region is heated by the heat generator 10 and the bubble 40 has started foaming with the film boiling. This state is equivalent to a period from a B point to immediately before a $C_1$ point in FIG. 5, which shows a state that the bubble volume $V_{d1}$ is increased as time passes. It is to be noted that, at this point, the displacement of the movable member 11 begins later than the volume change of the bubble 40. Specifically, the pressure wave based on generation of the bubble 40 due to the film boiling propagates in the flow path 3, and the liquid moves to the downstream side and the upstream side by making the central region of the bubble generation region a border, accordingly. In the upstream side, the movable member 11 begins to be displaced by the liquid flow with the growth of the bubble 40. And, the liquid movement to the upstream side is directed to the common liquid chamber 6 through the gap between the sidewall 20 of the flow path 3 and the movable member 11. The clearance between the stopper 12 and the movable member 11 at this point is reduced as the movable member 11 is displaced. The discharged droplet 66 begins to be discharged from the discharge part 4 in this state.

Figure 2C:
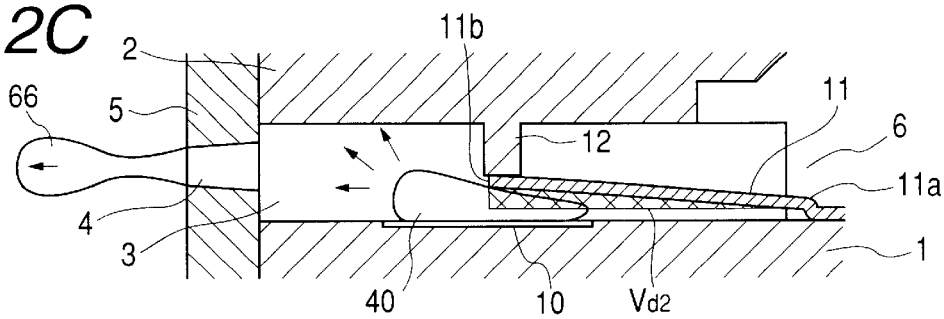

FIG. 2C shows a state where the free end 11*b* of the movable member 11 contacts the stopper 12 because of further growth of the bubble 40. This state is equivalent to a period from a $C_1$ point to $C_3$ point.

The changing rate of the displacement volume of the movable member $v_2$ is quickly reduced in a period from the state shown in FIG. 2B to the point before the state shown in FIG. 2C where the movable member 11 contacts the stopper 12, that is, at the B point in transition from the B point to the $C_1$ point in FIG. 5. The reduction is caused because the flow resistance of the liquid between the movable member 11 and the stopper 12 is quickly increased immediately before the movable member 11 contacts the stopper 2. The changing rate of the bubble volume $v_1$ is also reduced quickly.

Then, the movable member 11 further approaches to contact the stopper 12. The contact between the movable member 11 and the stopper 12 is more ensured by making the dimensions of the protrusion height $t_1$ of the stopper 12 and the clearance $t_2$ (=c) between the upper surface of the movable member 11 and the tip portion of the stopper 12 are defined as described above. And then, when the movable member 11 contacts the stopper 12, the displacement upward from the contact point is defined ($C_1$ to $C_3$ point in FIG. 5). Accordingly, the liquid movement to the upstream direction is largely limited. In accordance with this, the growth of the bubble 40 to the upstream side is limited by the movable member 11. However, since movement force of the liquid to the upstream direction is large, the movable member 11 receives a large amount of stress that pulls the movable member 11 to the upstream direction, which causes a little deformation upward in a convex state. At this point, although the bubble keeps on growing, the downstream side of the bubble 40 further grows because the growth to the upstream side is defined by the stopper 12 and the movable member 11, and the growth height of the bubble 40 in the downstream side of the heat generator 10 is higher in comparison with the case where the movable member 11 is not provided. Specifically, as shown in FIG. 5, the changing rate of the displacement volume of the movable member $v_2$ is zero in the period between the $C_1$ and the $C_3$ point because the movable member 11 contacts the stopper, and the bubble 40 keeps on growing to the downstream side until the $C_2$ point that is a little temporally later than the $C_1$ point and the bubble volume $V_{d1}$ is the maximum value at the $C_2$ point.

On the other hand, a portion of the bubble 40 in the upstream side is in a small size in the state where the inertial force of the liquid flow to the upstream side bends the movable member 11 in the convex shape toward the upstream side to charge the stress because the displacement of the movable member 11 is defined by the stopper 12. In a portion of the bubble 40 in the upstream side, the amount of the bubble that goes into the upstream side region is defined to almost as zero by the stopper 12, the sidewall of the flow path, the movable member 11 and the fulcrum 11*a*.

The liquid flow to the upstream side is largely defined with this to prevent a fluid cross talk to an adjacent flow path and backflow and pressure vibration, which blocks the high-speed refill, in a supply path system.

Figure 2D:
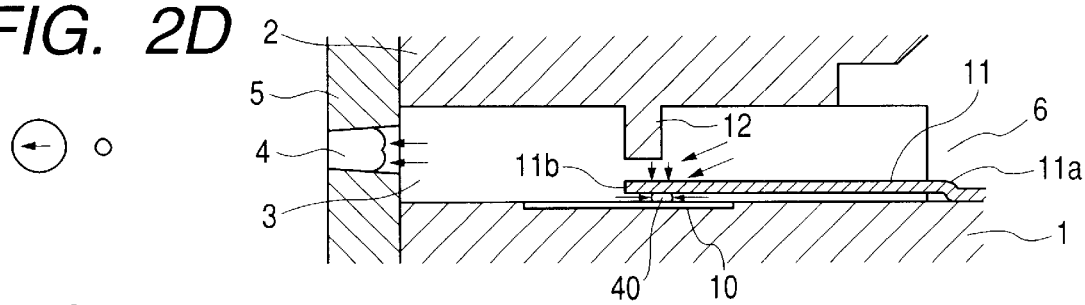

FIG. 2D shows the state where the negative pressure inside the bubble 40, after the foregoing film boiling, has overcome the liquid movement in the flow path 3 to the downstream side to begin the contraction of the bubble 40.

The movable member 11 is displaced downwardly (the $C_3$ point to a D point in FIG. 5) in accordance with the contraction of the bubble 40 (the $C_2$ point to an E point in FIG. 5). The movable member 11 has the stress of a cantilever spring and the stress of the upward convex deformation as described above, by which the downward displacement speed is increased. Then, since the flow of the liquid to the downstream direction in the upstream side of the movable member 11, which is a low flow path resistance region formed between the common liquid chamber 6 and the flow path 3, quickly becomes a large flow due to a small flow path resistance to flow into the flow path 3 via the stopper 12. With these operations, the liquid in the common liquid chamber 6 side is guided into the flow path 3. The liquid guided into the flow path 3 directly goes between the stopper 12 and the movable member 11 that has been displaced downwardly, flows to the downstream side of the heat generator 10, and simultaneously functions so as to promote disappearance the bubble 40 that has not completely disappeared yet. The liquid flow, after having helped disappearance, further forms a flow in the discharge part direction to help recover the meniscus, and thus increases the refill speed.

At this stage, a liquid column that consists of the discharged droplet 66, which has discharged from the discharge part 4, becomes the liquid droplet to be flown to outside.

Since the flow of the liquid into the flow path 3 via the portion between the foregoing movable member 11 and stopper 12 increases the flow speed in the top plate 2 side, there is few residual micro bubbles and the like, which contributes to the stability of discharge.

Moreover, since a cavitation generating point due to disappearance shifts to the downstream side of the bubble generation region, damage to the heat generator reduces. At the same time, this phenomenon also reduces adhesion of burn to the heat generator 10, which improves the discharge stability.

Figure 2E:
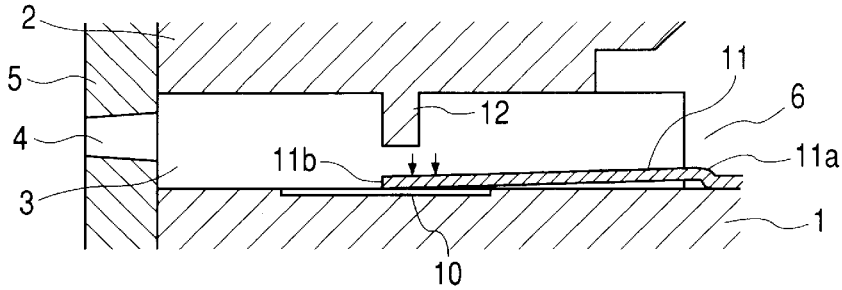

FIG. 2E shows the state where the movable member 11 is overshot downwardly from the initial state after the bubble 40 has been completely disappeared and is displaced (after the E point in FIG. 5).

The overshooting of the movable member 11 is damped and converged in a short time, although it depends on the rigidity of the movable member and the viscosity of the liquid used, to return to the initial state.

The case where the liquid discharge is normally performed has been described above with reference to FIG. 2A to FIG. 2E. In a conventional liquid discharge head, there has been the case where printing was deteriorated because the discharge amount and the discharge speed were reduced, the discharge direction became unstable and the like. Particularly, such a phenomenon may have occurred when the protrusion height of the stopper was 15 $\mu$m or more. When the inventors examined the causes of the printing deterioration, they found out that the bubble has been remained in the flow path as shown in FIG. 17A to FIG. 17G to cause the printing deterioration. Specifically, there has been the case where the dissolved gas in the ink became the bubble due to temperature increase and the like by the change by passage of time and the continuous foaming and the bubble stayed in the vicinity before and after the stopper. Normally, such a bubble is washed down by the ink flow to be discharged from the discharge part. However, there is a case where the bubble that exists in this position is not washed down but stays as it is because the ink flow proceeds so as to avoid the vicinity of the stopper and little liquid flow is made in the vicinity of the stopper. The bubble does not move but remains even if the ink discharge and refilling are repeated, and the bubble absorbs the bubble foaming power to cause the reduction of the discharge amount and the discharge speed and the unstable discharge direction.

On the contrary, in this embodiment, since there is a sufficient clearance "a" between the stopper 12 and the sidewall 20, ink flows passing the clearance "a". Accordingly, the bubble that exists in the vicinity of the stopper is washed down together with ink to be discharged from the discharge part.

Figure 6A:
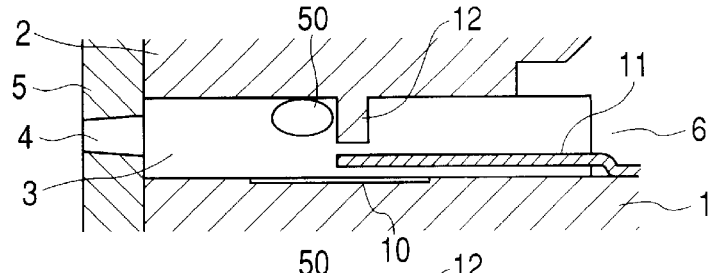
FIGS. 6A, 6B, 6C, 6D, 6E, 6F and 6G are views explaining discharge process of a remained bubble in the liquid discharge head shown in FIG. 1.
Figure 6B:
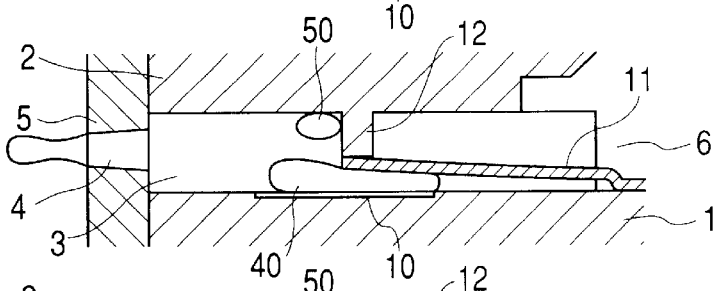
Figure 6C:
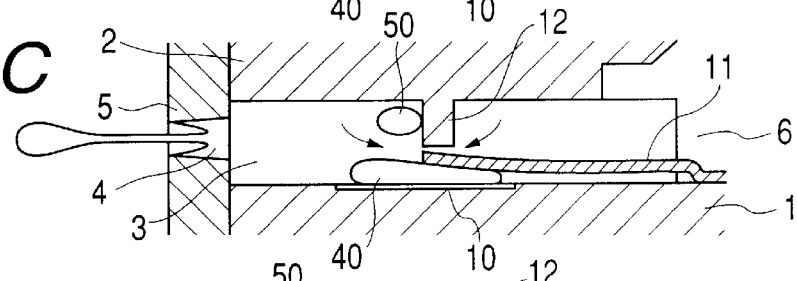
Figure 6D:
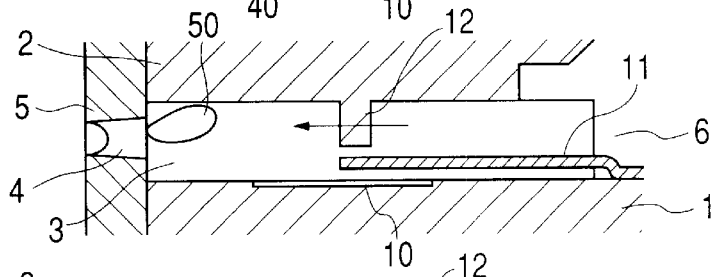
Figure 6E:
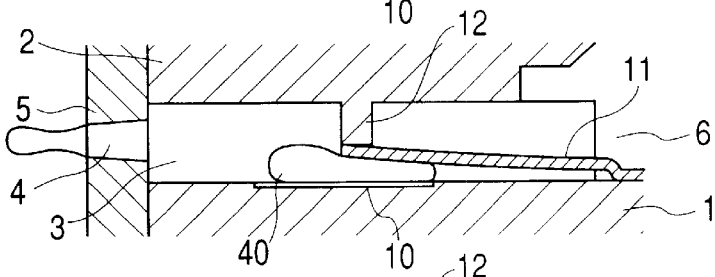
Figure 6F:
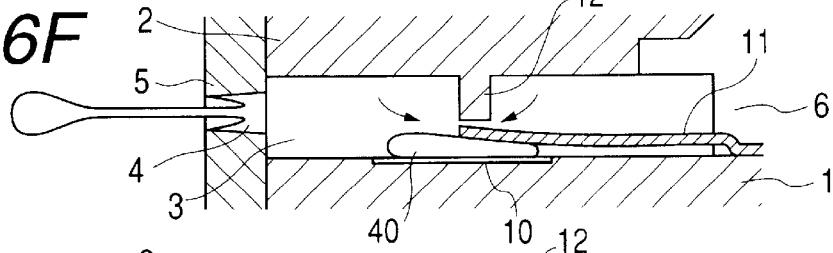
Figure 6G:
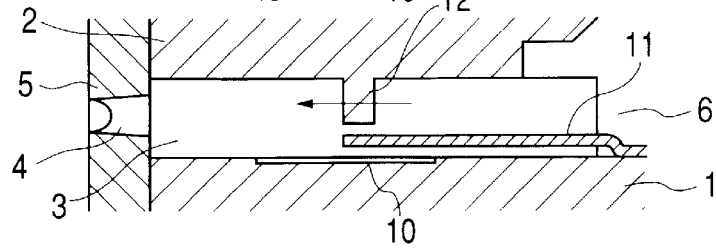

FIG. 6A to FIG. 6G show the case where a large remained bubble 50 is generated in the flow path 3 due to the change by passage of time during non-operation period of ink. As shown in FIG. 6A, preparatory discharge that does not contribute to printing is performed as a preliminary operation before a printing operation in the state where the large remained bubble 50 exists in the vicinity of the stopper 12. When power is supplied to the heat generator 10 for the preparatory discharge, the bubble 40 is generated to grow in near the heat generator 10, as shown in FIG. 6B, and a part of the bubble 40 protrudes from the discharge part. Then, when heating is stopped and the bubble 40 begins to contract as shown in FIG. 6C, the movable member 11 recovers from the maximum displacement state, and ink is drawn toward the bubble 40. And then, a part of ink that protrudes from the discharge part 4 is cut off from ink in the flow path 3 to be discharged as an ink droplet toward a preparatory discharge receiving member (not shown) in the outside. As shown in FIG. 6D, in the state where the bubble 40 is almost disappeared and the movable member 11 almost recovers to a stationary state, the ink flow occurs from the upstream side (the common liquid chamber 6 side) to the downstream side (the discharge part 4 side) so as to refill ink for an discharged amount. At this point, different from the conventional liquid discharge head, a flow that goes through sufficient clearance "a" between the stopper 12 and the sidewall 20 also occurs in this embodiment. This ink flow washes down and discharges the large remained bubble 50, which exists in the vicinity of the stopper, from the discharge part 4. As described, according to this embodiment, the large remained bubble 50 occurred due to the change by passage of time during the non-operation period of ink is discharged from the discharge part 4 at the time of refilling after the preparatory ink discharge. Accordingly, high-quality ink discharge can be performed during printing in the state where the remained bubble 50 does not exist in the flow path 3. It is to be noted that the front and the rear length of the stopper can be made longer to suppress ink movement to the upstream side during bubble foaming, depending on the dimension of the clearance.

Figure 7A:
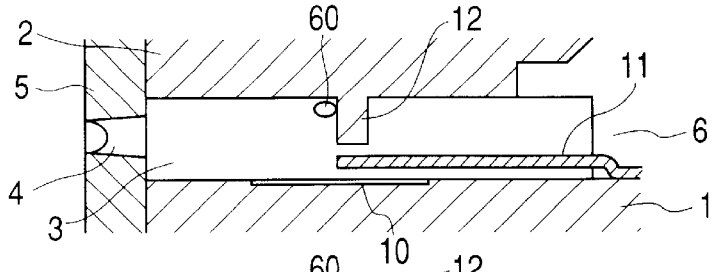
FIGS. 7A, 7B, 7C, 7D, 7E, 7F and 7G are other views explaining discharge process of a remained bubble in the liquid discharge head shown in FIG. 1.
Figure 7B:
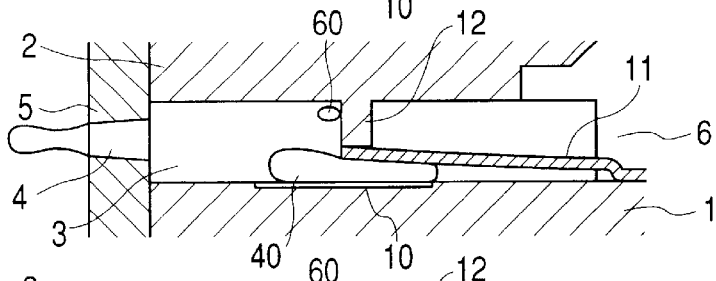
Figure 7C:
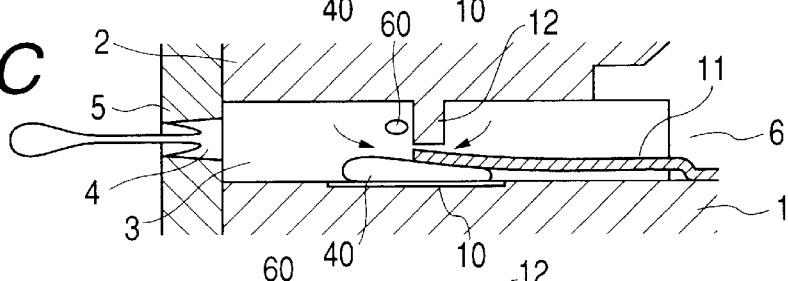
Figure 7D:
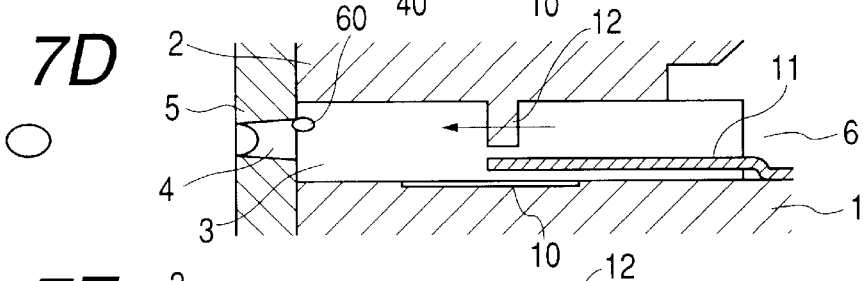
Figure 7E:
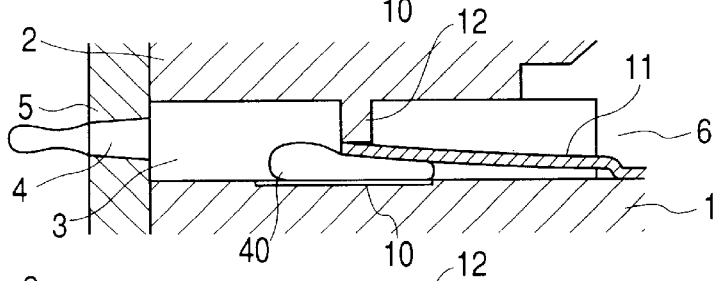
Figure 7F:
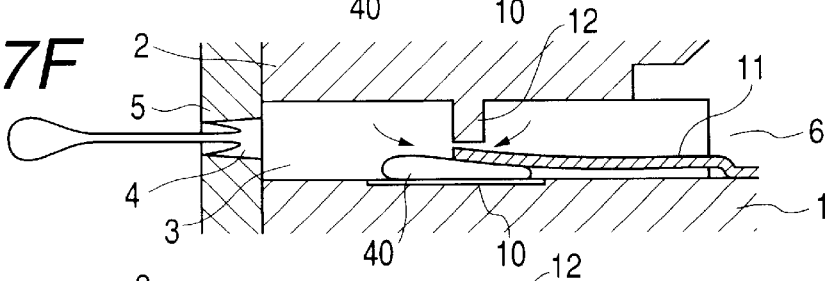
Figure 7G:
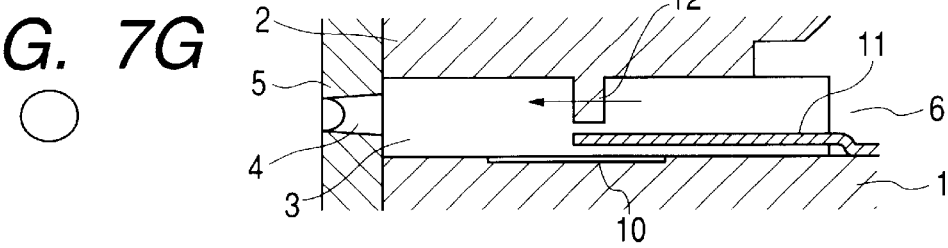

In addition, FIG. 7A to FIG. 7G show the case where a relatively small remained bubble 60 is generated in the flow path 3 due to temperature increase with continuous printing (continuous bubble foaming) during ink operation. In this case as well, when power is supplied to the heat generator 10 in the state where the remained bubble 60 exists in the vicinity of the stopper 12, substantially similarly to the case shown in FIG. 6A to FIG. 6G, the bubble 40 is generated near the heat generator 10 as shown in FIG. 7B. Then, when heating is stopped and the bubble 40 begins to contract as shown in FIG. 7C, ink is drawn toward the bubble 40 and the ink droplet is discharged to a recording medium 150 (refer to FIG. 15) or the like of the outside. And then, as shown in FIG. 7D, when the bubble 40 is almost deformed and the ink flow occurs from the upstream side (the common liquid chamber 6 side) to the downstream side (the discharge part 4 side), the flow that goes through the sufficient clearance "a" between the stopper 12 and the sidewall 20 also occurs. This ink flow washes down and discharges the remained bubble 60, which exists in the vicinity of the stopper, from the discharge part 4. As described, even if the remained bubble 60 is generated, it is occasionally discharged from the discharge part 4. Thus, it does not grow into a large remained bubble as shown in the case of FIG. 6A to FIG. 6G, but it is discharged together with ink before influence is given to printing quality.

Figure 8:
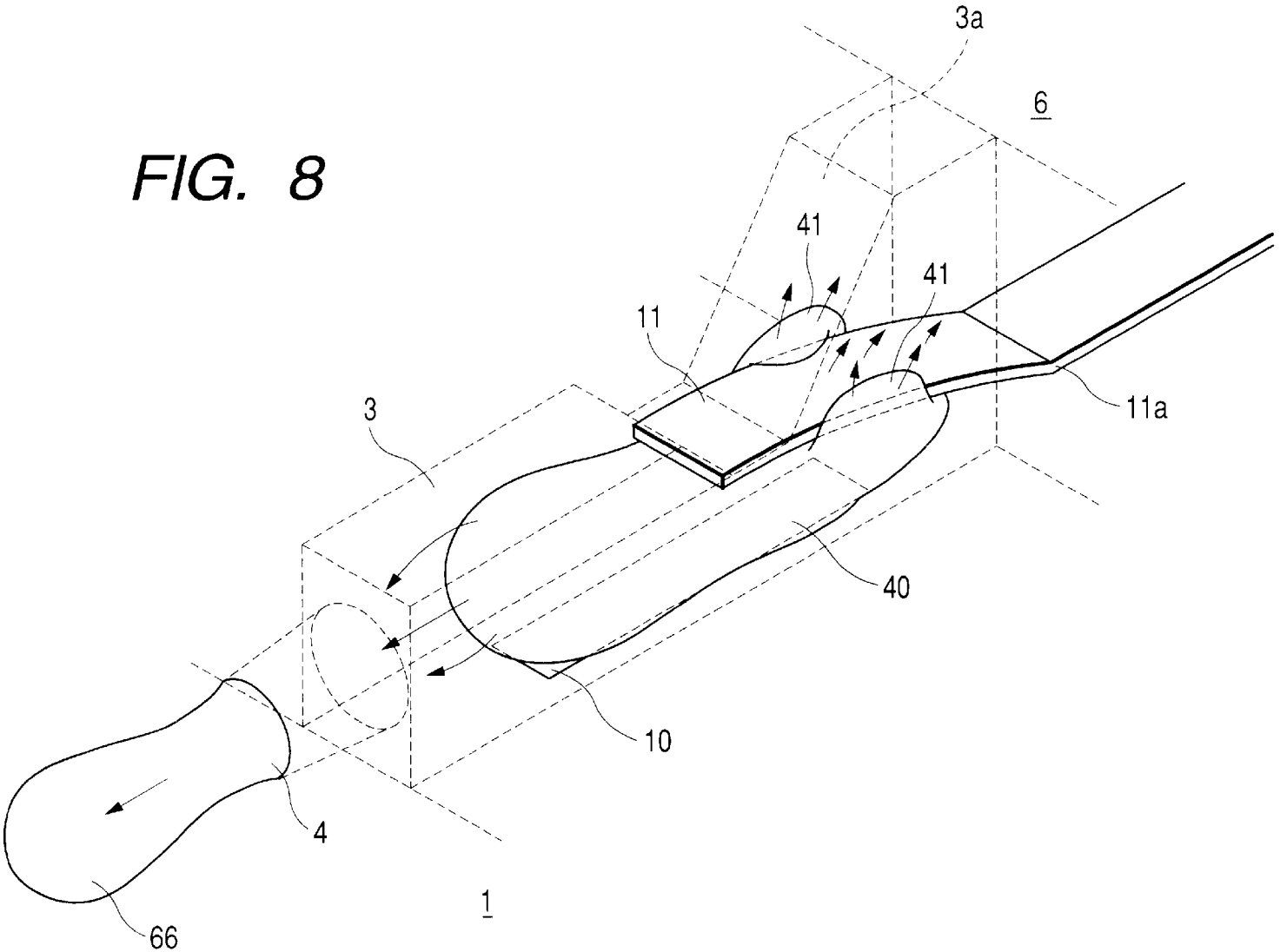
FIG. 8 is a perspective view of a principal portion of the liquid discharge head shown in FIG. 1.

Next, description will be made particularly regarding an elevated bubble 41 elevated from both side portions of the movable member 11 and the meniscus of the liquid at the discharge part 4 by using FIG. 8 being the transparent perspective view of the head shown in FIG. 1. It is to be noted that although the shape of the stopper 12 and the shape of the low flow path resistance region 3*a* in the upstream side from the stopper 12 are different from those shown in FIG. 1, basic characteristic are the same.

In this embodiment, the clearance "b" of a small amount exists between the wall surface of the sidewall 20 constituting the flow path 3 and the both side portions of the movable member 11, which enables a smooth displacement of the movable member 11. Furthermore, in a growing process of the bubble foaming by the heat generator 10, the bubble 40 displaces the movable member 11 and elevates toward the upper surface side of the movable member 11 via the foregoing clearance "b" to go into the low flow path resistance region 3*a* by a little amount. The elevated bubble 41 that has gone into the region controls the shaking of the movable member 11 and stabilizes the discharge characteristic by bending on the rear surface (the opposite surface to the bubble generation region) of the movable member.

Furthermore, in the bubble disappearance process of the bubble 40, the elevated bubble 41 promotes the liquid flow from a low flow path resistance region 703*a* to the bubble generation region, and completes disappearance in combination with a high-speed drawing back of the meniscus from the discharge part 4 side. Particularly, few bubbles remains in the corner of the movable member 11 and the flow path 3 by the liquid flow caused by the elevated bubble 41.

As described, in the liquid discharge head of the foregoing constitution, the discharged droplet 66 is discharged in a state close to the liquid column having a spherical portion at its tip at the moment when the liquid is discharged from the discharge part 4 by generation of the bubble 40. The same phenomenon occurs in a conventional head structure. However, in this embodiment, a space is formed in which the flow path 3 having the bubble generation region is substantially closed except for the discharge part 4 when the movable member 11 is displaced by the growing process of the bubble and the displaced movable member 11 contacts the stopper. Therefore, if the bubble is disappeared in this state, the closed spaced described above is maintained until the movable member 11 is released from the stopper 12, and thus, most of the disappearance energy of the bubble 40 works as a force to move the liquid in the vicinity of the discharge part 4 to the upstream direction. As a result, the meniscus is quickly drawn back from the discharge part 4 into the flow path 3 immediately after the disappearance of the bubble 40 has begun, and a tail portion that forms the liquid column by connecting with the discharged droplet 66 in the outside is quickly cut off by the meniscus with a strong force. With this action, the satellite dot formed by the tail portion becomes small and the printing resolution can be improved.

Moreover, since the tail portion is not continuously drawn by the meniscus for a long time, the discharge speed is not reduced and the distance between the discharged droplet 66 and the satellite dot is shortened. Thus, the satellite dot is drawn back to the rear of the discharged droplet 66 due to a so-called slipstream phenomenon. As a result, coalescence of the discharged droplet 66 and the satellite dot could occur, and the liquid discharge head with few satellite dots can be provided.

In addition, in this embodiment, the movable member 11 is provided to suppress only the bubble 40 that grows in the upstream direction regarding the liquid flow directed to the discharge part 4. More preferably, the free end 11*b* of the movable member 11 is positioned substantially at the central portion of the bubble generation region. According to this constitution, the inertial force of the back wave and the liquid to the upstream side due to the bubble growth can be suppressed, which is not directly related to the liquid discharge, and the growing component of the bubble 40 to the downstream side can be directed to the discharge part 4 directly.

Furthermore, since the flow path resistance of the low flow path resistance region 3*a*, which is in the opposite side to the discharge part 4 with the stopper 12 as a border, is low, the liquid movement to the upstream direction due to the growth of the bubble 40 becomes a large flow by the low flow path resistance region 3*a*. Thus, when the displaced movable member 11 contacts the stopper 12, the movable member 11 receives the stress that pulls the movable member 11 to the upstream direction. Accordingly, if disappearance begins in this state, the foregoing closed space can be maintained for a certain period of time until the repulsive force of the movable member 11 overcomes the liquid movement force because the liquid movement in the upstream direction due to the growth of the bubble 40 is largely residual. Specifically, a high-speed drawing back of the meniscus is more ensured with this constitution. When the disappearance process of the bubble 40 proceeds and the repulsive force of the movable member 11 overcomes the liquid movement force of the bubble growth in the upstream direction, the movable member 11 is displaced downwardly to return to the initial state and the flow in the downstream direction occurs in the low flow path resistance region 3*a* accordingly. The flow in the downstream direction in the low flow path resistance region 3*a* quickly becomes a large flow because of the small flow path resistance and flows into the flow path 3 via the stopper 12. As a result, the drawing back of the foregoing meniscus can be quickly stopped to converge the vibration of the meniscus in high-speed.

As described above, since the liquid discharge head of this embodiment has the large clearance "a" between the stopper 12 and the sidewall 20 of the flow path 3, the ink flow that goes through the clearance "a" occurs during the ink refilling and the like. Thus, the bubble in the vicinity of the stopper 12, which conventionally has been apt to remain, can be discharged and the discharge energy by heating can be effectively transmit to the liquid, and the liquid can be stably discharged so that a desired discharge characteristic can be certainly exerted.

Second Embodiment

Figure 9:
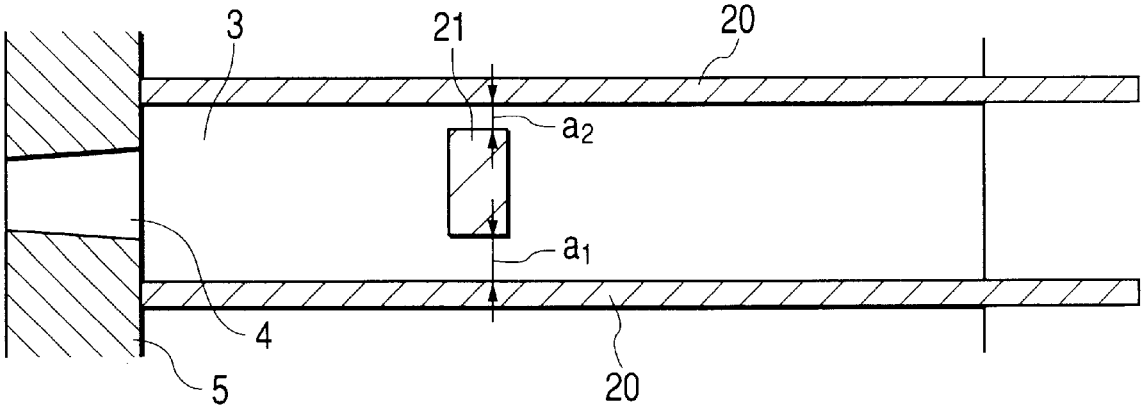
FIG. 9 is a sectional plan view of the principal portion of the liquid discharge head shown of a second embodiment of the present invention.

FIG. 9 is a typical plan view of the flow path of a second embodiment according to the present invention. Description is omitted for the portions substantially same as the first embodiment. In the first embodiment, the clearance "a" between the stopper 12 and the sidewall 20 of the flow path 3 was symmetric, but this embodiment has a constitution where only either one clearance "$a_1$" of a stopper 21 is large and the other clearance "$a_2$" is small. In this constitution, the ink flow that washes down the remained bubbles 50 and 60 in the vicinity of the stopper 21 can be generated, the same effect as the first embodiment can be obtained.

Third Embodiment

Figure 10:
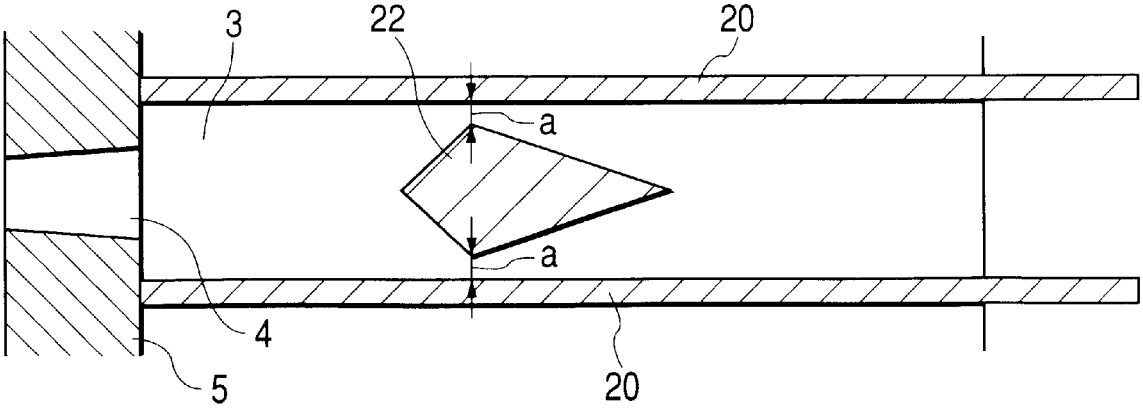
FIG. 10 is a sectional plan view of the principal portion of the liquid discharge head shown of a third embodiment of the present invention.

FIG. 10 is a typical plan view of the flow path of a third embodiment according to the present invention. Description is omitted for the portions substantially same as the first embodiment. In this embodiment, the both side edge portions of a stopper 22 is convex toward the sidewall 20 and is in a shape that the width thereof is continuously becomes narrower from the maximum width portion toward the upstream side and the downstream side. The large clearance "a" is maintained between the maximum width portions, that is, the tip portion of the convex shape and the sidewall 20 as described above. According to this embodiment, in addition to the effect of the first embodiment, a shape where the ink flow is apt to stagnate does not exist between the stopper 22 and the sidewall 20. Specifically, the remained bubbles 50 and 60 moves smoothly along a slope of the side edge portion of the stopper 22 and quickly discharged from the discharge part 4 together with the ink flow.

Fourth Embodiment

Figure 11:
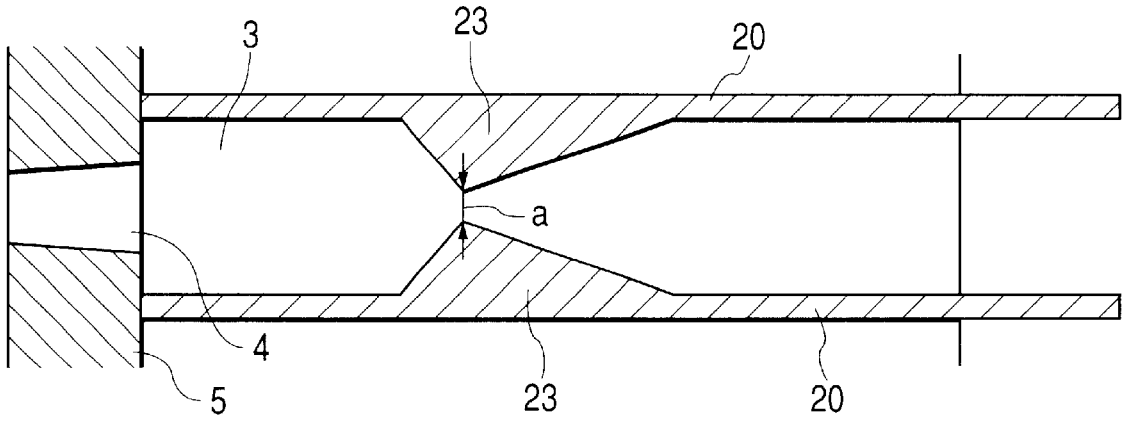
FIG. 11 is a sectional plan view of the principal portion of the liquid discharge head shown of a fourth embodiment of the present invention.

FIG. 11 is a typical plan view of the flow path of a fourth embodiment according to the present invention. Description is omitted for the portions substantially same as the first embodiment.

In this embodiment, stoppers 23 are severally formed on the both sidewalls 20 of the flow path 3. The stopper 23 has a shape that becomes convex toward the inside of a flow path 20, and is formed such that the width continuously becomes narrower from the maximum width portion toward the upstream side and the downstream side. The large clearance "a" is maintained between the both stoppers 23 at the tip portion of the convex shape, and the clearance "a" is the equal size as the clearance between the stopper 12 and the sidewall 20 in the first embodiment. According to this embodiment, in addition to the effect of the first embodiment, a shape where the ink flow is apt to stagnate does not exist between the stoppers 23. Specifically, similarly to the third embodiment, the remained bubbles 50 and 60 moves smoothly along a slope of the side edge portion of the stoppers 23 and quickly discharged from the discharge part 4 together with the ink flow.

Although it will not be described in detail, even with the constitution in which the stoppers 23 are severally formed on the both sidewalls 20 of the flow path 3, the same effect can be obtained by making the dimensions of the stopper 23, the movable member 11 and the flow path 3 be substantially the same dimensions as the first embodiment.

Movable Member

Next, description will be made in detail regarding the movable member 11 used in the liquid discharge head of each of the foregoing embodiments.

As a material for the movable member 11, the followings are desirable other than silicon nitride, which are: metal such as silver, nickel, gold, iron, titanium, aluminum, platinum, tantalum, stainless steel and phosphor bronze, having high durability, and alloy thereof; resin having nitrile group such as acrylonitrile, butadiene and styrene; resin having amide group such as polyamide; resin having carboxyl group such as polycarbonate; resin having aldehyde group such as polyacetals; resin having sulfone group such as polysulfone; resin such as other liquid crystal polymers and compound thereof; metal such as gold, tungsten, tantalum, nickel, stainless steel and titanium, having high ink-resistance, alloy thereof and one with improved ink-resistance by coating such material on the surface; or resin having amide group such as polyamide; resin having aldehyde group such as polyamide; resin having ketone group such as polyether etherketone; resin having imide group such as polyimide; resin having hydroxide group such as phenol resin; resin having ethyl group such as polyethylene; resin having alkyl group such as polypropylene; resin having epoxy group such as epoxy resin; resin having amino group such as melamine resin; resin having methylol group such as xylene resin and compound thereof; and ceramic such as silicon dioxide and silicon nitride and compound thereof.

Next, description will be made for the arrangement relation of the heat generator 10 and the movable member 11. Optimum arrangement of the heat generator 10 and the movable member 11 can appropriately control and effectively utilize the liquid flow during the bubble foaming by the heat generator 10.

Figure 12:
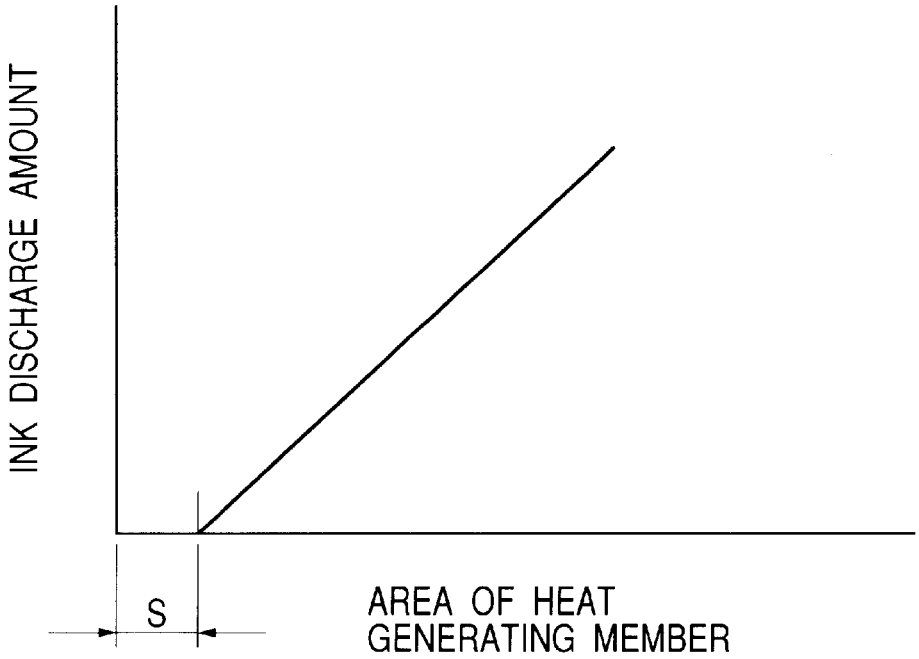
FIG. 12 is a graph showing a relation between a heat generator area and an ink discharge amount.

In a prior art of an ink-jet recording method in which a state change with steep volume change (generation of the bubble) is produced in ink by giving an energy such as heat to ink, ink is discharged from the discharge part 4 by an operating force based on the state change, and ink is adhered to the recording medium to form an image, which is a so-called bubble-jet recording method, the area of the heat generator and the ink discharge amount are in a proportional relation as shown in FIG. 12. It is noted that there exists a non-foaming effective region S. And, it is understood from the appearance of the burn that the non-foaming effective region S exists around the heat generator 10. As a result, the region including approximately 4 $\mu$m around the heat generator is not involved in the bubble foaming.

Accordingly, to utilize the bubble foaming pressure, the portion directly above the foaming effective region, which is 4 $\mu$m or more inside around the heat generator 10, is the region that effectively operates to the movable member 11. In the case of the present invention, it is extremely important that an operating step is divided into the step that individually operates to the liquid flows in the flow path 3 of the bubble in the upstream side and the downstream side from substantially central region of the bubble generation region (practically, the area of approximately 10 $\mu$m from the center in the liquid flow direction) and the step that generally operates to the liquid flows, and that the movable member 11 is arranged such that only the portion in the upstream side from the central region faces the movable member 11. In this embodiment, the bubble foaming effective region is 4 $\mu$m or more inside around the heat generator 10, but the region is not limited to this depending on the kind the forming method of the heat generator 10.

Element Substrate

Next, description will be made for the constitution of the element substrate 1 provided with the heat generator for giving heat to the liquid, which is used in the liquid discharge head of each of the foregoing embodiments.

Figure 13A:
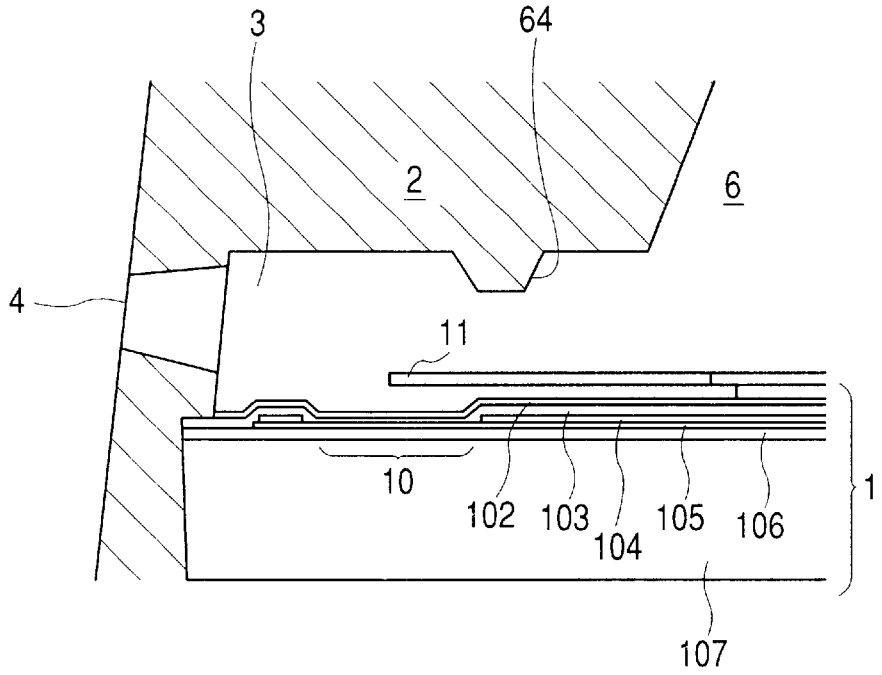
FIGS. 13A and 13B are typical sectional side views explaining a constitution of an element substrate of the liquid discharge head of the present invention.
Figure 13B:
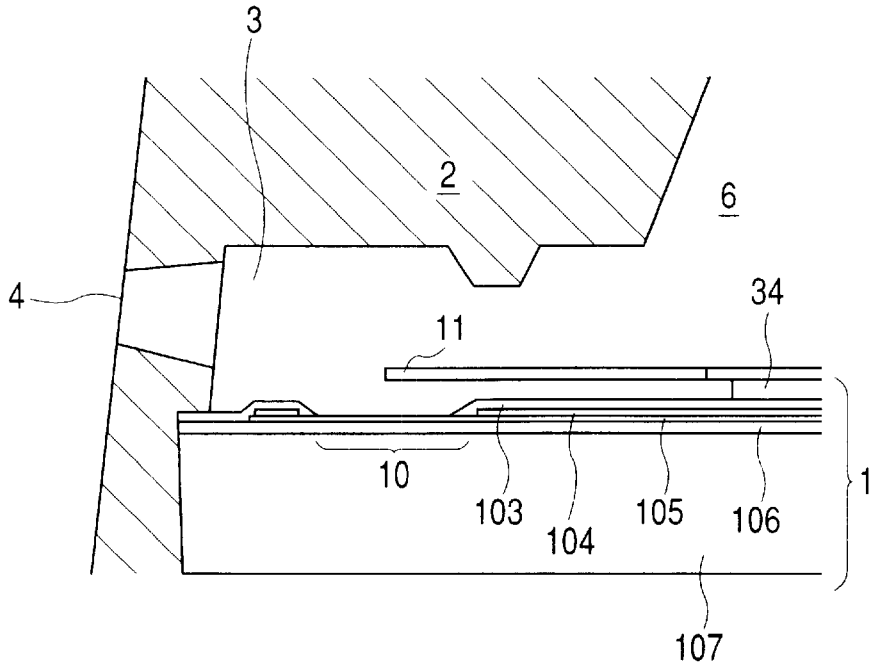

FIG. 13A and FIG. 13B show typical sectional side views of the principle portion of the liquid discharge head being an example of the present invention. FIG. 13A is the liquid discharge head with a protective film (described later) and FIG. 13B is the liquid discharge head without the protective film. The top plate 2 with a groove, in which the groove constituting the foregoing flow path 3 is provided, is arranged above the element substrate 1.

In the element substrate 1, a silicon oxide film or a silicon nitride film 106 aiming at insulation and heat storage is deposited on a base 10 such as silicon, and an electrical resistance layer 105 (the thickness of 0.01 to 0.2 $\mu$m) constituting the heat generator 10 such as hafnium boride (HfB2), tantalum nitride (TaN) and aluminum nitride (TaAl) and a wiring electrode 104 (the thickness of 0.2 to 1.0 $\mu$m) such as aluminum are patterned as shown in FIG. 13A. A voltage is applied from the wiring electrode 104 to a resistance layer 105, and a current is flown to the resistance layer 105 to generate heat. A protective layer 103 of silicon oxide, silicon nitride or the like is formed on the resistance layer 105 between the wiring electrodes 104 in the thickness of 0.1 to 2.0 $\mu$m, and an anti-cavitation layer 102 such as tantalum (the thickness of 0.1 to 0.6 $\mu$m) is further deposited thereon to protect the resistance layer 105 from various kinds of liquid such as ink.

Particularly, a pressure and a shock wave generated during generation and disappearance of the bubble 40 is very strong, and they significantly reduces the durability of an oxide film that is hard and fragile. Accordingly, a metal material such as tantalum (Ta) or the like is used as the anti-cavitation layer 102. Alternatively, a constitution in which the resistance layer 105 does not require the protective film 103 may be adopted depending on the combination of the liquid, a flow path constitution and a resistance material. An example of such constitution is shown in FIG. 13B. As a material for the resistance layer 105 that does not require the protective film 103, an iridium-tantalum-aluminum alloy is cited.

As described, as a constitution of the heat generator 10 in each of the foregoing embodiments, only the resistance layer 105 (heat generation portion) between the electrodes 104 may be adopted, or a constitution including the protective film 103 to protect the resistance layer 105 may be adopted.

In each embodiment, one having the heat generation portion, which is constituted of the resistance layer 105, that generates heat in accordance with an electric signal is used as the heat generator 10. However, the heat generator is not limited to such type. One that generates the bubble 40 having a sufficient size for discharging the liquid to be discharged in a foaming liquid may be adopted. For example, a photothermo converter that generates heat by receiving a beam such as a laser and the heat generator having the heat generation portion that generates heat by receiving a high frequency may be used.

Furthermore, other than the heat generator 10 constituted of the resistance layer 105 constituting the foregoing heat generation portion and the wiring electrode 104 for supplying the electrical signal to the resistance layer 105, function devices such as a transistor, a diode, a latch and a shift register that selectively drive the heat generator 10 (an electro-thermal converter) may be integrally fabricated on the element substrate 1 by a semiconductor manufacturing process.

Figure 14:
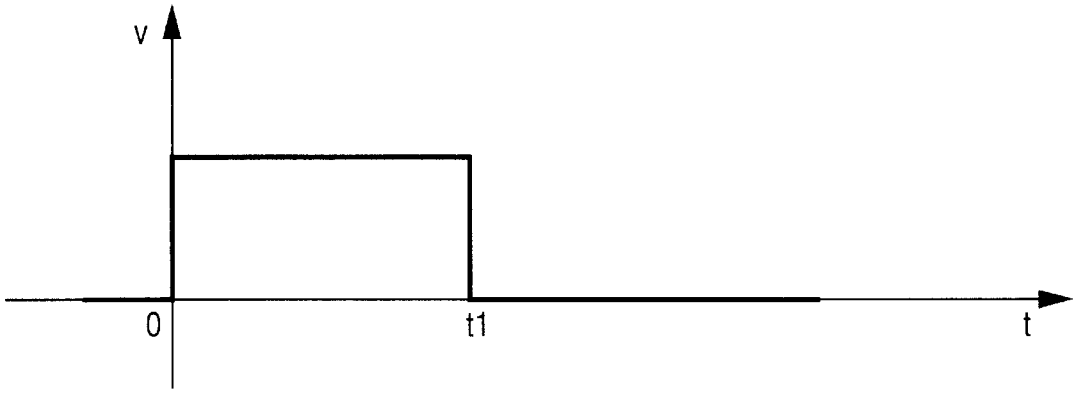
FIG. 14 is a graph showing a pulse waveform applied to the heat generator.

To discharge the liquid by driving the heat generation portion of the heat generator 10 provided on the element substrate 1, a rectangular pulse as shown in FIG. 14 is applied to the foregoing resistance layer 105 via the wiring electrode 104 to generate heat steeply the resistance layer 105 between the wiring electrodes 104. In the head of each of the foregoing embodiments, the heat generator 10 was driven by applying the voltage 24 [V], the pulse width 7 [$\mu$m], the current 150 [mA] and the electrical signal 6 [kHz], and ink being the liquid was discharged from the discharge part 4 by the above-described operation. However, the conditions of the drive signal are not limited to this, and any drive signal that can appropriately foam the foaming liquid may be used.

Recording Apparatus

In the following, description will be made regarding an example of a recording apparatus using the liquid discharge head that has been described in each embodiment.

Figure 15:
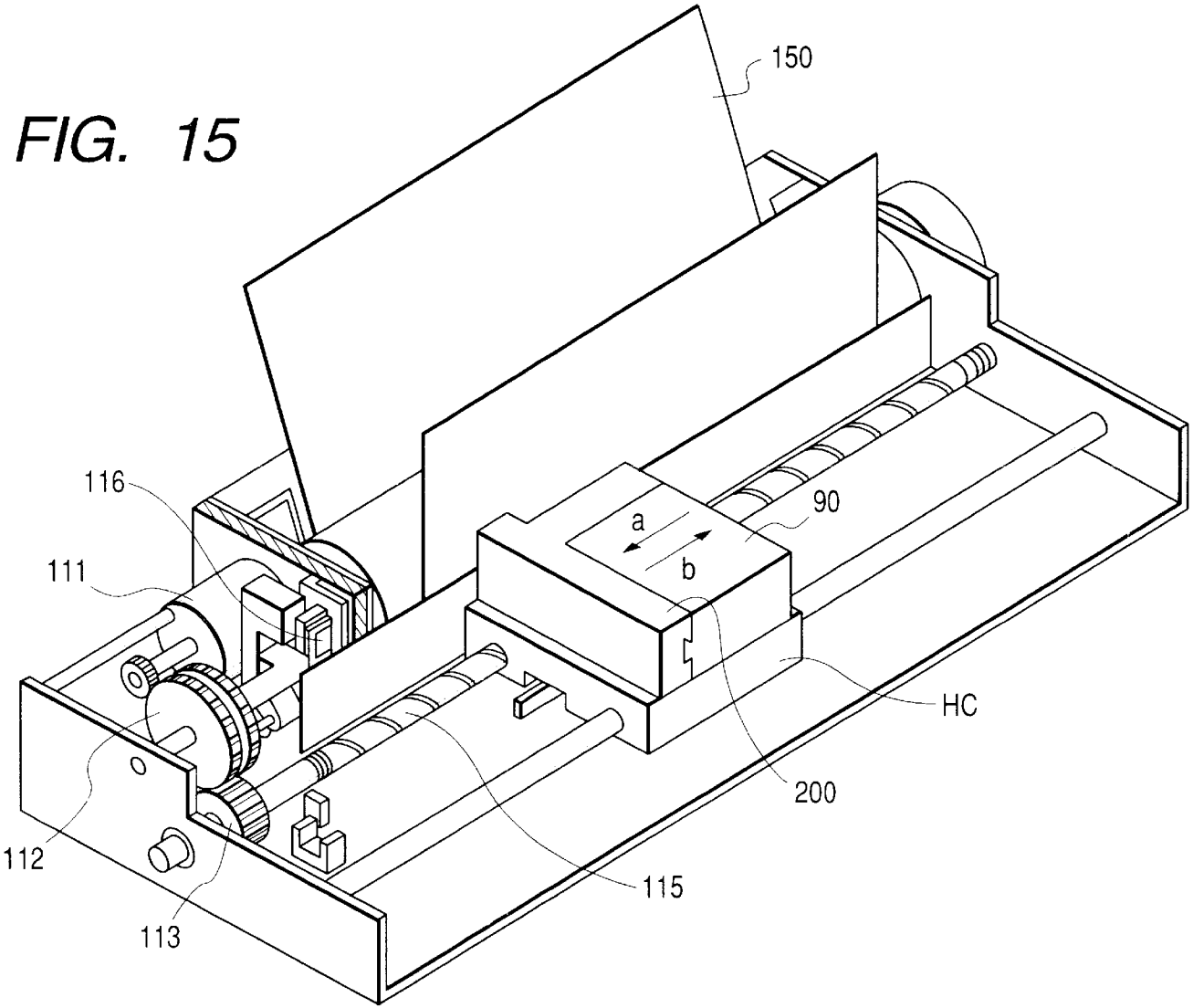
FIG. 15 is a typical perspective view showing an example of a recording apparatus of the present invention.

FIG. 15 is a typical perspective view showing an example of a recording apparatus assembled with the foregoing liquid discharge head and using ink as a discharge liquid. A carriage HC mounts a head cartridge capable of attaching/detaching a liquid tank portion 90 to contain ink and a recording head portion being the liquid discharge head 200, which reciprocates in a width direction of a recording medium 150 such as a recording paper carried by recording medium carrying means.

When the drive signal is supplied to liquid discharge means on the carriage HC from drive signal supply means (not shown), ink (recording liquid) is discharged from the recording head portion to the recording medium in accordance with the signal.

In addition, the recording apparatus of this embodiment includes: a motor 111 as a drive source to drive the recording medium carrying means and the carriage; gears 112 and 113, a carriage shaft 115, a recovery apparatus 116 and the like. A recording of a good image could be obtained by discharging the liquid to various kinds of recording media, with this recording apparatus and the liquid discharge method performed by the recording apparatus.

Figure 16:
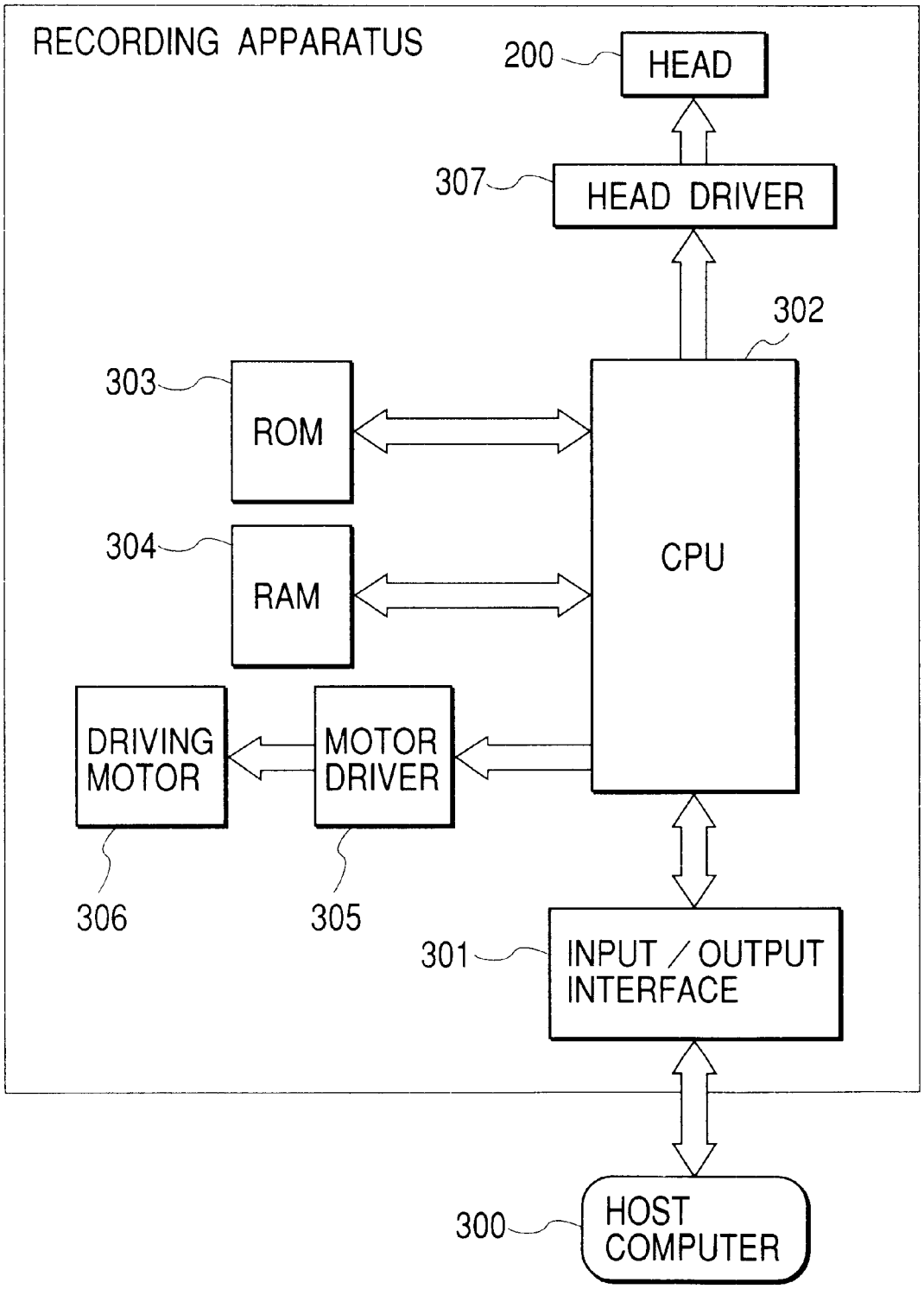
FIG. 16 is a block diagram of an entire recording apparatus for performing an ink-jet recording by the liquid discharge head of the present invention.
Figure 17A:
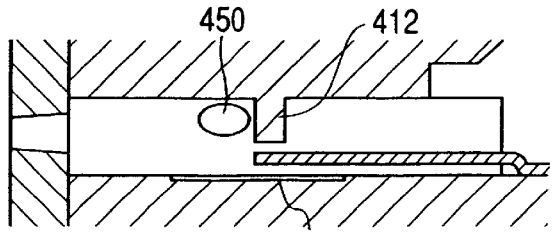
PRIOR ART FIG. 17A
FIGS. 17A, 17B, 17C, 17D, 17E, 17F and 17G are views explaining discharge process of the liquid from a conventional liquid discharge head.
Figure 17B:
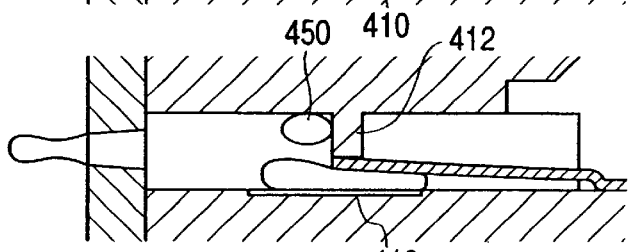
PRIOR ART FIG. 17B
Figure 17C:
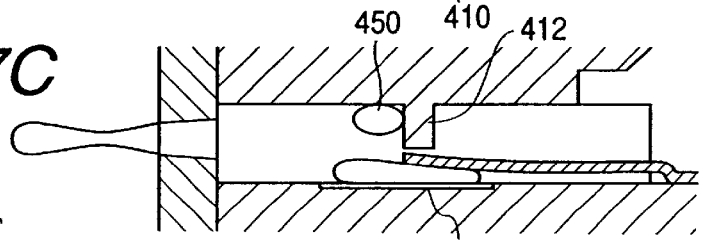
PRIOR ART FIG. 17C
Figure 17D:
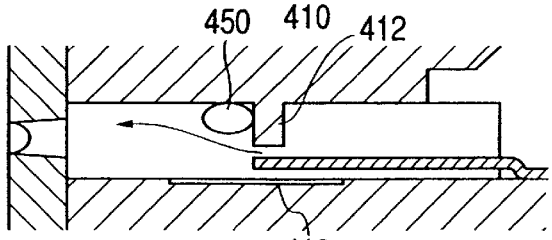
PRIOR ART FIG. 17D
Figure 17E:
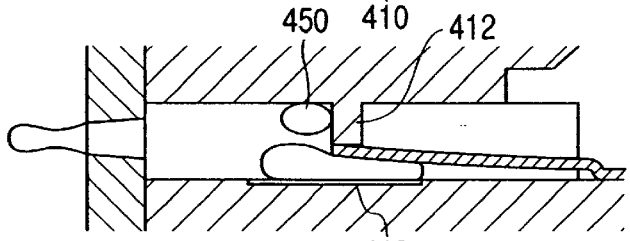
PRIOR ART FIG. 17E
Figure 17F:
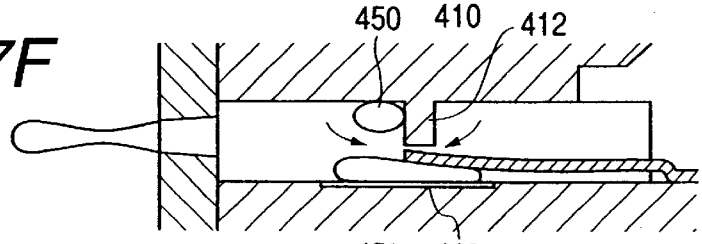
PRIOR ART FIG. 17F
Figure 17G:
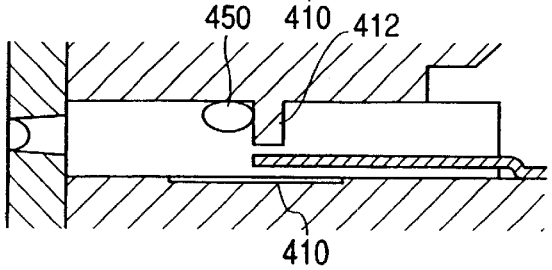
PRIOR ART FIG. 17G

FIG. 16 is a block diagram of the entire recording apparatus for performing an ink-jet recording by the liquid discharge head of each of the foregoing embodiments.

The recording apparatus receives printing information from a host computer 300 as the drive signal. The printing information is temporarily stored in an input interface in the printing apparatus, and at the same time, is converted into processible data in the recording apparatus, and then input to a CPU (a central processing apparatus) 302 that also serves as head drive signal supply means. The CPU 302 based on a control program stored in a ROM (a read only memory) 303, processes the data input to the foregoing CPU 302 by using a peripheral apparatus such as a RAM (a random access memory) 304 to convert into data (image data) to be printed.

Further, the CPU 302 makes drive data for driving a driving motor 306, which is synchronized with the image data to move the carriage mounting the recording paper and the recording head portion, in order to record the image data on a proper position of the recording paper. The image data and motor driving data are transferred to the recording head portion 200 and the driving motor 306 via a head driver 307 and a motor driver 305 respectively to be driven in a controlled timing, and form an image.

As the recording medium 150 used in the recording apparatus of this kind and to which the liquid such as ink is attached, the followings can be used, which are: various kinds of papers and OHP sheet; a plastic material used for a compact disc, a decoration plate and the like; a cloth; metal material such as aluminum and copper; leather material such as calf skin, pig skin and artificial leather, a wood material such as a wood and a block board; a bamboo material; a ceramics such as a tile; a three-dimensional structure body such as a sponge; and the like.

Furthermore, the recording apparatus includes: a printer apparatus that performs recording to various kinds of papers, OHP sheet and the like; a recording apparatus for plastic that performs recording to the plastic material such as the compact disc; a recording apparatus for metal that performs recording to the metal plate; a recording apparatus for leather that performs recording to leather; a recording apparatus for wood that performs recording to the block board; a recording apparatus for ceramics that performs recording to the ceramic material; a recording apparatus that performs recording to the three-dimensional mesh structure body such as the sponge; and a textile printing apparatus that performs recording to the cloth.

Additionally, as the discharge liquid used for the liquid discharge heads, a liquid that conforms to each recording medium and recording conditions.

According to the present invention, the clearance between the sidewall and the side edge portion of the restricting portion is large, and the liquid can flow through the clearance. Accordingly, even if the remained bubble exists in the vicinity of the restricting portion, the foregoing liquid flow occurred during refilling of the liquid and the like washes down and the remained bubble can be discharged from the discharge part. Therefore, the bubble foaming pressure due to heat generation for the liquid discharge is not absorbed by the remained bubble but is effectively transmitted to the liquid, and thus the liquid can be stably discharged.

When the side edge portion of the restricting portion has a shape where its width continuously becomes narrower from the maximum width portion toward the upstream side and downstream side, the remained bubble moves smoothly along the side edge portion of the restricting portion, and the discharge of the remained bubble can be performed more certainly.

What is claimed is:

1. A liquid discharge head, comprising:

a heat generator that generates a thermal energy for generating a bubble in a liquid;

a discharge part as a portion to discharge said liquid;

a flow path communicating with the discharge part and having a bubble generation region in which the bubble is generated;

a movable member having a free end and displaced with the growth of said bubble; and a restricting portion to define a displacement amount of said movable member, in which said flow path is formed by joining a substantially flat substrate provided with said heat generator and said movable member with a top plate opposing to said substrate and including said restricting portion, and said liquid is discharged from said discharge part by an energy during generation of said bubble, wherein a clearance between at least a sidewall of said flow path and the side edge portion of said restricting portion is larger than a clearance between said sidewall of said flow path and the side edge portion of said movable member.

2. The liquid discharge head according to claim 1, wherein the clearance between said movable member and said restricting portion along a height direction of said flow path, in a non-displacement state of said movable member, is larger than said clearance between said sidewall of said flow path and said side edge portion of said movable member and is smaller than said clearance between said sidewall of said flow path and said side edge portion of said restricting portion.

3. The liquid discharge head according to claim 1, wherein a sum of the clearance between said movable member and said restricting portion along a height direction of said flow path and the clearance between said movable member and the bottom surface of said flow path, in a non-displacement state of said movable member, is smaller than said clearance between said sidewall of said flow path and said side edge portion of said restricting portion.

4. The liquid discharge head according to claim 1, wherein a distance between said restricting portion and the bottom surface of said flow path in a height direction of said flow path is 15 $\mu$m or more, said clearance between said sidewall of said flow path and said side edge portion of said restricting portion is 4 $\mu$m or more, and a width of said restricting portion is 90% or under of a width of said flow path.

5. The liquid discharge head according to claim 1, wherein both of said side edge portions of said restricting portion are convex toward said sidewall of said flow path and have a shape in which the width of the side edge portion continuously becomes narrower from the maximum width portion to an upstream direction and a downstream direction.

6. The liquid discharge head according to claim 5, wherein said maximum width portion of said restricting portion abuts said movable member in a displaced state to define a displacement amount of the movable member.

7. The liquid discharge head according to any one of claims 1 to 6, wherein said flow path is substantially closed in the maximum displaced state of said movable member by abutting said movable member on said restricting portion.

8. A liquid discharge apparatus, comprising: the liquid discharge head according to claim 7, wherein a remaining bubble in a dissolved gas in said liquid, the bubble being left in said flow path due to a bubble foaming and change by passage of time, is discharged from said discharge part together with said liquid through said clearance between said side edge portion of said movable member and said one sidewall.

9. The liquid discharge apparatus according to claim 8, further comprising:

recovery means for recovering the state of said liquid discharge head, wherein said remaining bubble is discharged by said recovery means.

10. A liquid discharge apparatus, comprising: the liquid discharge head according to any one of claims 1 to 6, wherein a remaining bubble in a dissolved gas in said liquid, the bubble being left in said flow path due to a bubble foaming and a change by passage of time, is discharged from said discharge part together with said liquid through said clearance between said side edge portion of said movable member and said one sidewall.

11. The liquid discharge apparatus according to claim 10, further comprising:

recovery means for recovering the state of said liquid discharge head, wherein said remaining bubble is discharged by the recovery means.

12. The liquid discharge apparatus according to claim 11, further comprising:

recovery means for recovering the state of said liquid discharge head, wherein said remained bubble is discharged by the recovery means.

13. A liquid discharge head, comprising:

a heat generator that generates a thermal energy for generating a bubble in a liquid;

a discharge part as a portion to discharge said liquid;

a flow path communicating with the discharge part and having a bubble generation region in which the bubble is generated;

a movable member having a free end that is displaced with the growth of said bubble; and restricting portions to define a displacement amount of said movable member, in which said flow path is formed by joining a substantially flat substrate provided with said heat generator, said movable member and a top plate opposing to said substrate and including said restricting portion, wherein said liquid is discharged from said discharge part by an energy during generation of said bubble, wherein said restricting portions are formed respectively on two sidewalls of said flow path and have a shape that becomes convex toward the inside of said flow path, and a clearance between said restricting portions is larger than a clearance between one of said sidewalls and a side edge portion of said movable member nearest to said one sidewall.

14. The liquid discharge head according to claim 13, wherein the clearance between said movable member and said restricting portions along a height direction of said flow path in a non-displacement state of said movable member is larger than said clearance between said one sidewall and said side edge portion of said movable member and is smaller than said clearance between said restricting portions.

15. The liquid discharge head according to claim 13, wherein a sum of the clearance between said movable member and said restricting portions along a height direction of said flow path and the clearance between said movable member and the bottom surface of said flow path in a non-displacement state of said movable member is smaller than said clearance between said restricting portions.

16. The liquid discharge head according to claim 13, wherein a distance between said restricting portions and the bottom surface of said flow path in the height direction of said flow path is 15 $\mu$m or more, the clearance between said sidewalls is 4 $\mu$m or more, and the sum of the widths of said restricting portions is 90% or under of the width of said flow path.

17. The liquid discharge head according to any one of claims 13 to 16, wherein said restricting portions are convex toward the inside of said flow path, and have a shape in which the width of each of said restricting portions continuously becomes narrower from a maximum width portion toward an upstream side and a downstream side.

18. A liquid discharge apparatus, comprising: the liquid discharge head according to claim 17, wherein such remaining bubble in a dissolved gas in said liquid, the bubble being left in said flow path due to a bubble foaming and change by passage of time, is discharged from said clearance between said restricting portions together with said liquid through said clearance between said side edge portion of said movable member and said one sidewall.

19. The liquid discharge apparatus according to claim 18, further comprising:

recovery means for recovering the state of said liquid discharge head, wherein such remaining bubble is discharged by the recovery means.

20. The liquid discharge head according to claim 17, wherein said maximum width portions of said restricting portions abut said movable member in a displaced state to define the displacement amount of the movable member.

21. The liquid discharge head according to claim 13, wherein said flow path is substantially closed in the maximum displaced state of said movable member by abutting said movable member on said restricting portions.

22. A liquid discharge apparatus, comprising: the liquid discharge head according to any one of claims 13 to 16 or 21, wherein such remaining bubble in a dissolved gas in said liquid, the bubble being left in said flow path due to a bubble foaming and a change by passage of time, is discharged from said clearance between said restricting portions together with said liquid through said clearance between said side edge portion of said movable member and said one sidewall.

* * * * *

UNITED STATES PATENT AND TRADEMARK OFFICE

CERTIFICATE OF CORRECTION

PATENT NO. : 6,491,382 B2
DATED : December 10, 2002
INVENTOR(S) : Yoichi Taneya et al.

It is certified that error appears in the above-identified patent and that said Letters Patent is hereby corrected as shown below:

Column 1,
Line 45, “followings” should read -- following changes --;
Line 57, “back wave being loss energy” should read -- loss of energy due to a back wave --;
Line 60, “No” should read -- No. --; and
Line 64, “that” should read -- in which --.

Column 2,
Line 11, “completes” should read -- proceeds to completion --; and “does” should read -- did --;
Line 17, “micro bubbles” should read -- micro-bubbles --;
Line 18, “breaks the principle where” should read -- represents a departure from the behavior in which --; and
Line 66, “that” should read -- in which --.

Column 3,
Line 6, “element” should read -- elements --;
Line 7, “relative” should be deleted;
Line 11, “this conventionally” should read -- the conventional approach’s opportunities --;
Line 35, “is hard to flow” should read -- cannot flow easily --;
Line 36, “stagnate” should read -- stagnates --;
Line 40, “disappeared.” should read -- then disappears. --;
Line 47, “412,” should read -- 412 during --; and
Line 49, “and then” should be deleted.

Column 4,
Line 3, “an” should read -- a --; and
Line 33, “clearance” should read -- clearances --.

Column 7,
Line 32, “ponent” should read -- ponents --;
Line 47, “an” (both occurrences) should be deleted; and
Line 50, “occurred” should read -- caused --.

UNITED STATES PATENT AND TRADEMARK OFFICE

CERTIFICATE OF CORRECTION

PATENT NO. : 6,491,382 B2
DATED : December 10, 2002
INVENTOR(S) : Yoichi Taneya et al.

It is certified that error appears in the above-identified patent and that said Letters Patent is hereby corrected as shown below:

Column 8,
Line 24, “and due” should read -- , and because of --;
Line 32, “the state where” should read -- it difficult for --; and
Line 33, “is hard” should be deleted.

Column 10,
Line 45, “are” should read -- equal to the dimensions mentioned --; and
Line 46, “defined as described” should be deleted.

Column 11,
Line 38, “the” should read -- of the --; and
Line 49, “is” should read -- are --.

Column 12,
Line 53, “an” should read -- a --.

Column 13,
Line 58, “remains” should read -- remain --.

Column 15,
Line 8, “transmit” should read -- transmitted --;
Line 30, “is” (second occurrence) should be deleted;
Line 40, “moves” should read -- move --; and
Line 62, “moves” should read -- move --.

Column 16,
Line 9, “followings” should read -- following --;
Line 10, “metal” should read -- metals --;
Line 13, “alloy” should read -- alloys --;
Line 19, “metal” should read -- metals --; and
Line 20, “alloy” should read -- alloys --.

Column 17,
Line 22, “(HfB2),” should read -- ($HfB_2$), --.

UNITED STATES PATENT AND TRADEMARK OFFICE

CERTIFICATE OF CORRECTION

PATENT NO. : 6,491,382 B2
DATED : December 10, 2002
INVENTOR(S) : Yoichi Taneya et al.

It is certified that error appears in the above-identified patent and that said Letters Patent is hereby corrected as shown below:

Column 18,
Line 8, “the” should read -- in the --.

Column 19,
Line 3, “followings” should read -- following --;
Line 8, “ceramics” should read -- ceramic --; and
Line 25, “conditions” should read -- conditions can be used --.

Signed and Sealed this

Ninth Day of September, 2003

JAMES E. ROGAN
*Director of the United States Patent and Trademark Office*